US011512866B2

(12) United States Patent
Umekage et al.

(10) Patent No.: US 11,512,866 B2
(45) Date of Patent: Nov. 29, 2022

(54) INDOOR UNIT FOR AIR-CONDITIONING APPARATUS

(71) Applicant: Mitsubishi Electric Corporation, Tokyo (JP)

(72) Inventors: Yuhei Umekage, Tokyo (JP); Makoto Kurihara, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 281 days.

(21) Appl. No.: 16/499,547

(22) PCT Filed: Jun. 15, 2017

(86) PCT No.: PCT/JP2017/022081

§ 371 (c)(1),
(2) Date: Sep. 30, 2019

(87) PCT Pub. No.: WO2018/229923

PCT Pub. Date: Dec. 20, 2018

(65) Prior Publication Data

US 2020/0363091 A1 Nov. 19, 2020

(51) Int. Cl.
*F24F 11/79* (2018.01)
*F24F 11/72* (2018.01)
(Continued)

(52) U.S. Cl.
CPC ..... *F24F 11/79* (2018.01); *F24F 1/0014* (2013.01); *F24F 1/0047* (2019.02); *F24F 2110/10* (2018.01); *F24F 2110/20* (2018.01); *F24F 2120/12* (2018.01); *F24F 2130/00* (2018.01)

(58) Field of Classification Search
CPC ..... F24F 1/0014; F24F 11/79; F24F 2120/12; F24F 2110/20; F24F 2110/10; F24F 1/0047; F24F 2130/00
See application file for complete search history.

(56) References Cited

U.S. PATENT DOCUMENTS 7,185,504 B2 * 3/2007 Kasai ..... F24F 1/0047 62/186
10,288,303 B2 * 5/2019 Yaegashi ..... F24F 1/0022
(Continued)

FOREIGN PATENT DOCUMENTS

JP S63-143449 A 6/1988
JP H02-187553 A 7/1990
(Continued)

OTHER PUBLICATIONS

Office Action dated Jun. 16, 2020 issued in corresponding JP patent application No. 2019-524649 (and English Translation).
(Continued)

*Primary Examiner* — Steven S Anderson, II
(74) *Attorney, Agent, or Firm* — Posz Law Group, PLC

(57) ABSTRACT

An indoor unit for an air-conditioning apparatus includes an air-sending unit configured to send air subjected to heat exchange with refrigerant to an air-conditioning target space through an air outlet, the air-conditioning target space being divided into a plurality of areas, an up-and-down airflow direction adjuster configured to adjust an angle in an up-and-down direction of a blowing direction of the air sent through the air outlet, a right-and-left airflow direction adjuster configured to adjust an angle in a right-and-left direction of the blowing direction of the air sent through the air outlet, and a controller configured to control the angle of the up-and-down airflow direction adjuster and the angle of the right-and-left airflow direction adjuster. The controller is configured to control the up-and-down airflow direction adjuster and the right-and-left airflow direction adjuster to continuously change the angle in the up-and-down direction and the angle in the right-and-left direction.

13 Claims, 13 Drawing Sheets

(51) Int. Cl.

| | |
|---|---|
| ***F24F 1/0007*** | (2019.01) |
| ***F24F 1/0047*** | (2019.01) |
| ***F24F 1/0014*** | (2019.01) |
| *F24F 110/20* | (2018.01) |
| *F24F 120/12* | (2018.01) |
| *F24F 130/00* | (2018.01) |
| *F24F 110/10* | (2018.01) |

(56) References Cited

U.S. PATENT DOCUMENTS

| | | | | |
|---|---|---|---|---|
| 10,302,326 | B2 * | 5/2019 | Son | F24F 13/10 |
| 2004/0079094 | A1 | 4/2004 | Kasai et al. | |

FOREIGN PATENT DOCUMENTS

| | | | |
|---|---|---|---|
| JP | H03-103955 | U | 10/1991 |
| JP | H11-173629 | A | 7/1999 |
| JP | 2957378 | B2 | 10/1999 |
| JP | 2003-194389 | A | 7/2003 |
| JP | 2006-220405 | A | 8/2006 |
| JP | 2007-024453 | A | 2/2007 |
| JP | 2008-292034 | A | 12/2008 |
| JP | 2009-180460 | A | 8/2009 |
| JP | 2010-210132 | A | 9/2010 |
| JP | 2016-023833 | A | 2/2016 |
| WO | 2017/022114 | A1 | 2/2017 |

OTHER PUBLICATIONS

International Search Report of the International Searching Authority dated Aug. 29, 2017 for the corresponding International application No. PCT/JP2017/022081 (and English translation).

Extended European Search Report dated May 27, 2019 issued in corresponding EP patent application No. 17889536.3.

Office Action dated Oct. 29, 2020 issued in corresponding CN patent application No. 201780091134.0 (and English Translation).

* cited by examiner

INDOOR UNIT FOR AIR-CONDITIONING APPARATUS

CROSS REFERENCE TO RELATED APPLICATION

This application is a U.S. national stage application of PCT/JP2017/022081 filed on Jun. 15, 2017, the contents of which are incorporated herein by reference.

TECHNICAL FIELD

The present invention relates to an indoor unit for an air-conditioning apparatus having a configuration for changing a blowing direction of air to be directed to an air-conditioning target space.

BACKGROUND ART

As a related-art indoor unit for an air-conditioning apparatus, there has been known an indoor unit having an air inlet formed at a center portion on a lower surface side of a casing and four air outlets formed to surround four sides of the air inlet, and configured to send air having been subjected to heat exchange to an indoor space through the four air outlets (see Patent Literature 1). The air-conditioning apparatus disclosed in Patent Literature 1 includes an infrared sensor configured to detect a temperature of an object and a first flap and a second flap which are provided to each of the four air outlets. The first flap is configured to change a right-and-left direction of the air which blows out through the air outlet. The second flap is configured to change a vertical direction of the air which blows out through the air outlet.

The air-conditioning apparatus disclosed in Patent Literature 1 has air-conditioning modes including a temperature equalization mode of equalizing a temperature in an air-conditioning target space and a spot air-conditioning mode of intensively air-conditioning a periphery of a human body which is present in the air-conditioning target space. This air-conditioning apparatus selects any one of the spot air-conditioning mode and the temperature equalization mode on the basis of measurement information acquired through measurement by the infrared sensor, and operation information.

The temperature equalization mode is an operation mode of equalizing a temperature in an entire space of the air-conditioning target space. The temperature equalization mode causes the first flap and the second flap at each air outlet to be set to "swing" to equalize the temperature in the air-conditioning target space, thereby being capable of achieving a comfortable air-conditioning state.

The spot air-conditioning mode is an air-conditioning mode of intensively air-conditioning a periphery of a person who is present in the air-conditioning target space and avoiding needless air-conditioning of a portion at which a person is not present. In the spot air-conditioning mode, for the air-conditioning target space which is divided into a plurality of areas, the number of people who are present in each area is calculated, and the first flaps and the second flaps are controlled depending on the calculated number, thereby improving energy-saving performance.

CITATION LIST

Patent Literature

Patent Literature 1: Japanese Unexamined Patent Application Publication No. 2003-194389

SUMMARY OF INVENTION

Technical Problem

In the air-conditioning apparatus disclosed in Patent Literature 1, when the same number of people are present in each area of the plurality of areas of the air-conditioning target space, the temperature equalization mode is set. In the temperature equalization mode, the air-conditioning apparatus causes the first flaps to swing in the right-and-left direction and causes the second flaps to swing in an up-and-down direction.

In the air-conditioning apparatus disclosed in Patent Literature 1, when timings of swings of each of the first flaps and a corresponding one of the second flaps do not match, airflow rates may differ among the areas. As a result, there are formed an area having a high airflow rate and an area having a low airflow rate, with the result that unevenness in temperature may occur. There has been a demand for achieving a finely air-conditioned space requested by a user regardless of a position of the user in the air-conditioning target space.

The present invention has been made to solve the above-mentioned problem, and has an object to provide an indoor unit for an air-conditioning apparatus capable of reducing temperature unevenness in the air-conditioning target space and improving comfortability of a user.

Solution to Problem

According to one embodiment of the present invention, there is provided an indoor unit for an air-conditioning apparatus, including an air-sending unit configured to send air subjected to heat exchange with refrigerant to an air-conditioning target space through an air outlet, the air-conditioning target space being divided into a plurality of areas, an up-and-down airflow direction adjuster provided at the air outlet, and configured to adjust an angle in an up-and-down direction of a blowing direction of the air sent through the air outlet, a right-and-left airflow direction adjuster provided at the air outlet, and configured to adjust an angle in a right-and-left direction of the blowing direction of the air sent through the air outlet, and a controller configured to control the angle of the up-and-down airflow direction adjuster and the angle of the right-and-left airflow direction adjuster. The controller is configured to control the up-and-down airflow direction adjuster and the right-and-left airflow direction adjuster to continuously change the angle in the up-and-down direction and the angle in the right-and-left direction such that the blowing direction of the air is switched to areas of the plurality of areas.

Advantageous Effects of Invention

According to one embodiment of the present invention, to the air-conditioning target space which is divided into the plurality of areas, the indoor unit continuously changes the up-and-down airflow direction and the right-and-left airflow direction to switch the blowing direction of the air to areas of the plurality of areas, thereby being capable of equally air-conditioning the air-conditioning target space. As a result, the temperature unevenness in the air-conditioning target space is reduced, thereby improving comfortability of a user.

DESCRIPTION OF EMBODIMENTS

Embodiment 1

Figure 1:
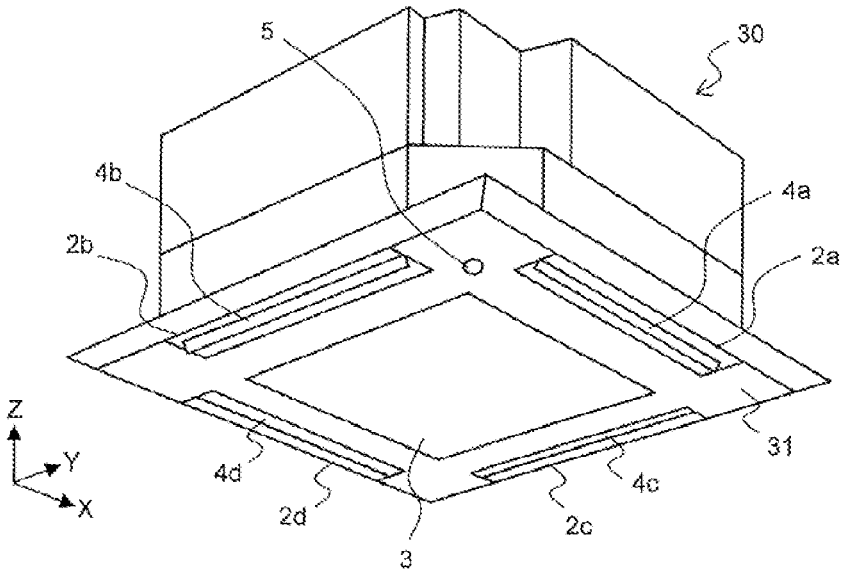
FIG. 1 is an outer appearance perspective view for illustrating a configuration example of an indoor unit for an air-conditioning apparatus according to Embodiment 1 of the present invention.
Figure 2:
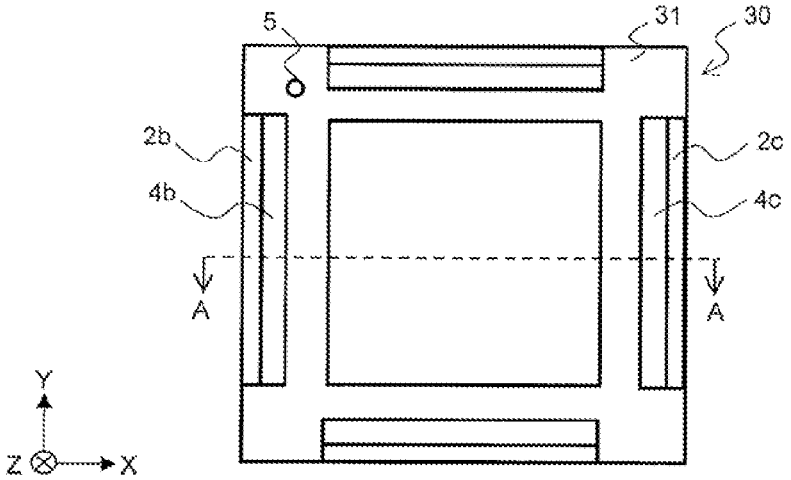
FIG. 2 is a plan view of the indoor unit illustrated in FIG. 1 as seen from a lower surface side.
Figure 3:
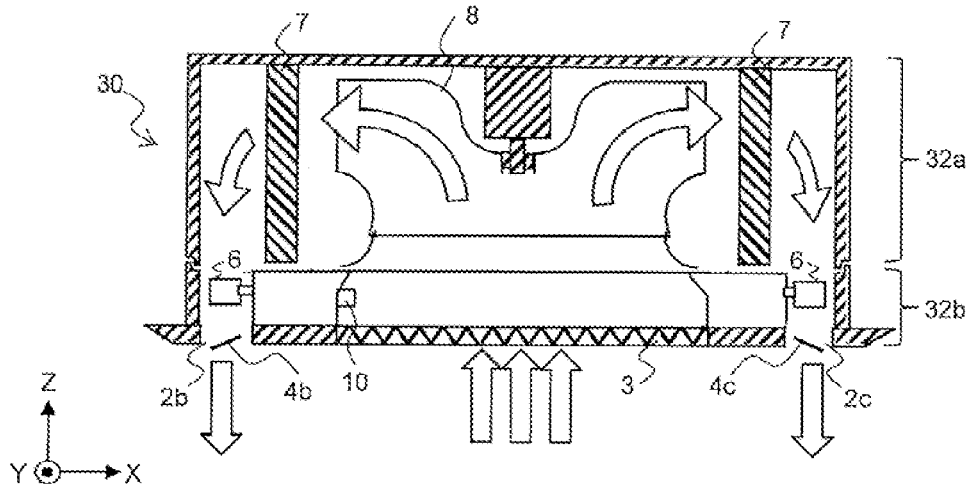
FIG. 3 is a schematic sectional view of the indoor unit taken along broken line A-A illustrated in FIG. 2.

Description is made of a configuration of an air-conditioning apparatus in Embodiment 1 of the present invention. FIG. 1 is an outer appearance perspective view for illustrating a configuration example of an indoor unit for an air-conditioning apparatus according to Embodiment 1 of the present invention. FIG. 2 is a plan view of the indoor unit illustrated in FIG. 1 as seen from a lower surface side. FIG. 3 is a schematic sectional view of the indoor unit taken along broken line A-A illustrated in FIG. 2.

In Embodiment 1, an indoor unit 30 illustrated in FIG. 1 is a four-direction ceiling cassette type indoor unit. The indoor unit 30 includes a casing having a rectangular parallelepiped shape. The indoor unit 30 is embedded in a ceiling of a room which is an air-conditioning target space. As illustrated in FIG. 2, a lower surface 31 of the indoor unit 30 has a rectangular shape, and is exposed to an indoor space side from the ceiling. An air inlet 3 having a rectangular shape is formed at a center in the lower surface 31 of the indoor unit 30. A latticed frame is provided to the air inlet 3, but illustration of the frame is omitted in the figures. Along four sides in an outer periphery of the air inlet 3, there are formed four air outlets 2*a* to 2*d* on an outer side of the air inlet 3.

As illustrated in FIG. 1, up-and-down airflow direction adjusters 4*a* to 4*d* are provided to the air outlets 2*a* to 2*d*, respectively. The up-and-down airflow direction adjusters 4*a* to 4*d* adjust angles of air sent to the indoor space through the air outlets 2*a* to 2*d* in an up-and-down direction. Further, a right-and-left airflow direction adjuster 6 illustrated in FIG. 3 is provided to each one of the air outlets 2*a* to 2*d*. The right-and-left airflow direction adjusters 6 adjust angles of air sent to the indoor space through the air outlets 2*a* to 2*d* in a right-and-left direction. Further, as illustrated in FIG. 1 and FIG. 2, a temperature measurement unit 5 configured to measure a temperature of air in the indoor space is provided to the lower surface 31 of the indoor unit 30.

In Embodiment 1, the right-and-left direction corresponds to a direction horizontal to the air-conditioning target space, with each of the air outlets 2*a* to 2*d* as a reference. Further, the up-and-down direction corresponds to a direction perpendicular to the horizontal direction, with each of the air outlets 2*a* to 2*d* as a reference.

As illustrated in FIG. 3, the indoor unit 30 includes an upper casing 32*a* and a lower casing 32*b*. The indoor unit 30 can be separated into the upper casing 32*a* and the lower casing 32*b*. In the upper casing 32*a*, there are provided an air-sending unit 8 and a load-side heat exchanger 7. In the lower casing 32*b*, there are provided the air inlet 3, the air outlets 2*a* to 2*d*, the right-and-left airflow direction adjusters 6, and the up-and-down airflow direction adjusters 4*a* to 4*d*. A humidity measurement unit 10 is provided to the air inlet 3 of the lower casing 32*b*. The humidity measurement unit 10 is configured to measure a humidity of air sucked from the indoor space through the air inlet 3. Arrows illustrated in FIG. 3 each indicate a flow of air. When the air-sending unit 8 is rotated, air is sucked into the indoor unit 30 through the air inlet 3. The air having been sucked into the indoor unit 30 is subjected to heat exchange with refrigerant flowing through the load-side heat exchanger 7, and then returns to the indoor space through the air outlets 2*a* to 2*d*.

Figure 4:
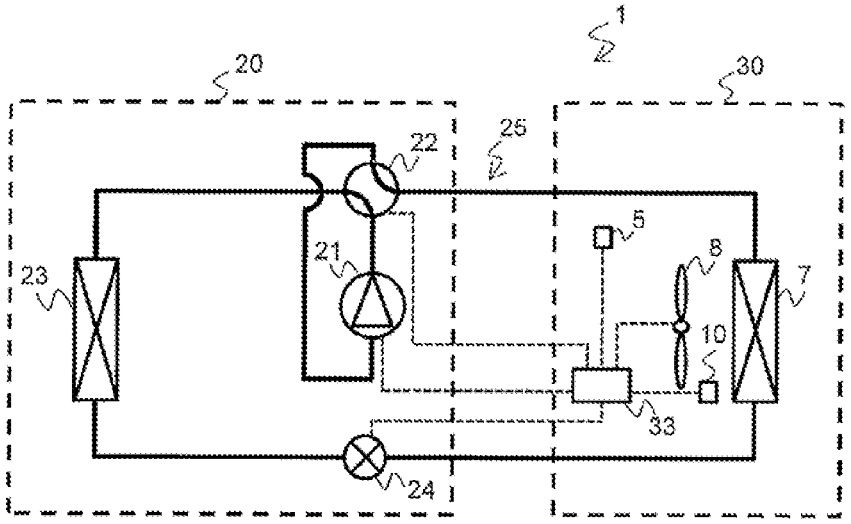
FIG. 4 is a refrigerant circuit diagram for illustrating a configuration example of the air-conditioning apparatus in Embodiment 1 of the present invention.

FIG. 4 is a refrigerant circuit diagram for illustrating a configuration example of the air-conditioning apparatus in Embodiment 1 of the present invention. As illustrated in FIG. 4, an air-conditioning apparatus 1 includes an outdoor unit 20 and the indoor unit 30 illustrated in FIG. 1 to FIG. 3. The outdoor unit 20 includes a compressor 21, a four-way valve 22, a heat source-side heat exchanger 23, and an expansion valve 24. The indoor unit 30 includes a controller 33 illustrated in FIG. 4, in addition to the load-side heat exchanger 7 and the air-sending unit 8 illustrated in FIG. 3. A refrigerant circuit 25 has a configuration in which the compressor 21, the four-way valve 22, the heat source-side heat exchanger 23, the expansion valve 24, and the load-side heat exchanger 7 are connected to one another by refrigerant pipes.

Figure 5:
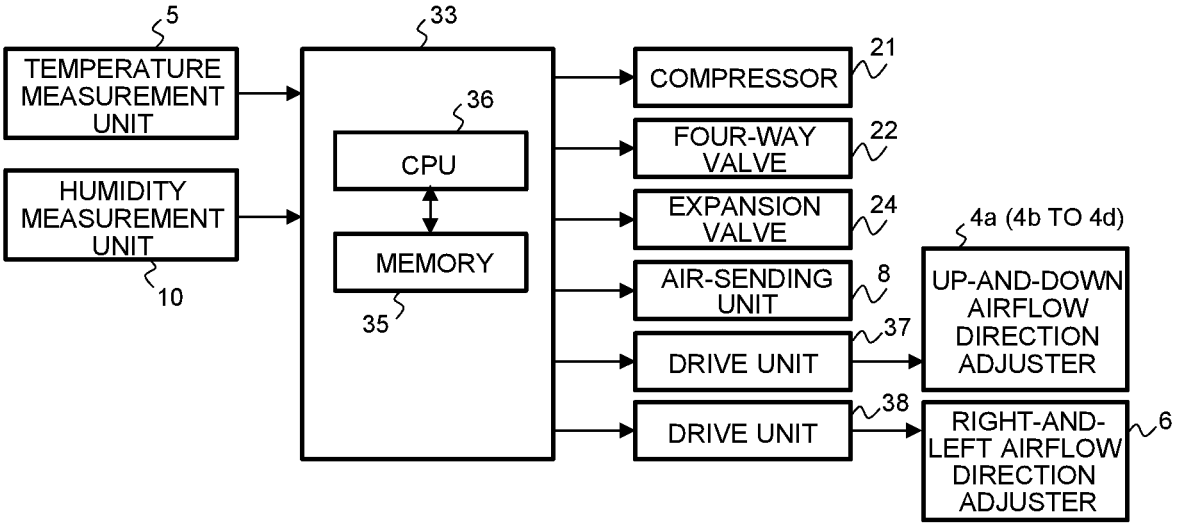
FIG. 5 is a block diagram for illustrating a configuration example of a controller illustrated in FIG. 4.

FIG. 5 is a block diagram for illustrating a configuration example of the controller illustrated in FIG. 4. The controller 33 includes a memory 35 and a central processing unit (CPU) 36. The memory 35 is configured to store a program. The CPU 36 is configured to execute processing in accordance with the program. The controller 33 is connected to the temperature measurement unit 5, the humidity measurement unit 10, the air-sending unit 8, the compressor 21, the four-way valve 22, and the expansion valve 24 by signal lines. The controller 33 is connected to a drive unit 37 configured to drive the up-and-down airflow direction adjusters 4*a* to 4*d* by signal lines. Further, the controller 33 is connected to a drive unit 38 configured to drive the plurality of right-and-left airflow direction adjusters 6 by signal lines. In FIG. 1 to FIG. 4, illustration of the drive units 37 and 38 is omitted.

Figure 6:
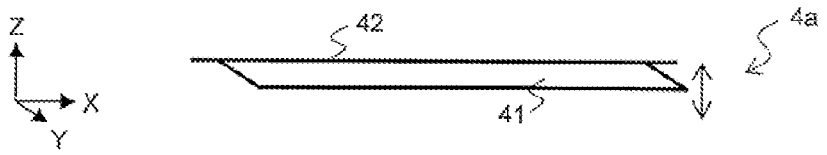
FIG. 6 is a perspective view for illustrating a configuration example of an up-and-down airflow direction adjuster illustrated in FIG. 1.
Figure 7:
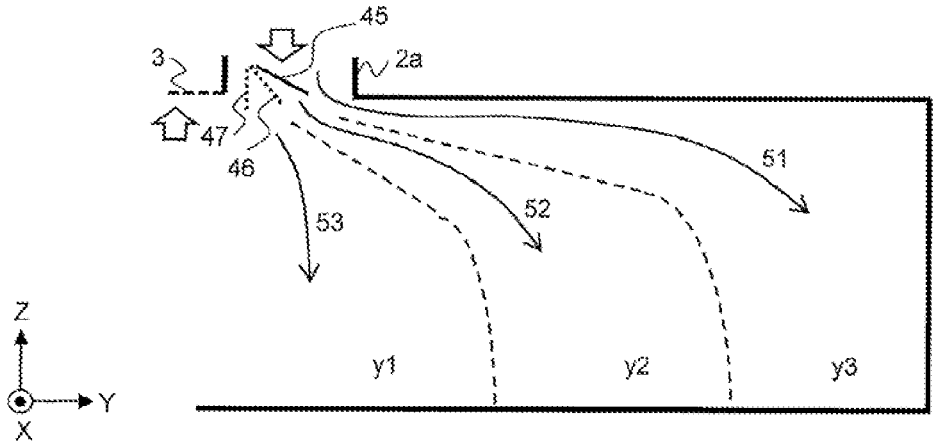
FIG. 7 is an illustration of an example of a case in which an angle of an airflow direction is changed by the up-and-down airflow direction adjuster illustrated in FIG. 6.

Description is made below of configurations of the up-and-down airflow direction adjusters 4*a* to 4*d* and the right-and-left airflow direction adjusters 6. FIG. 6 is a perspective view for illustrating a configuration example of the up-and-down airflow direction adjuster illustrated in FIG. 1. FIG. 7 is an illustration of an example of a case in which an angle of the airflow direction is changed by the up-and-down airflow direction adjuster illustrated in FIG. 6. In FIG. 6 and FIG. 7, for ease of description, the configuration is schematically illustrated. The up-and-down airflow direction adjusters 4*a* to 4*d* each have the same configuration, and hence description is made with the up-and-down airflow direction adjuster 4*a*.

As illustrated in FIG. 6, the up-and-down airflow direction adjuster 4*a* includes an up-and-down vane 41 and a shaft portion 42. As illustrated in FIG. 6, the up-and-down vane 41 is a plate-like part having a rectangular shape. A longitudinal length of the up-and-down vane 41 is equal to a longitudinal length of the air outlet 2*a* illustrated in FIG. 1. The shaft portion 42 is mounted to the up-and-down vane 41 in parallel at an edge of the up-and-down vane 41 on an edge side opposite to an edge side facing the indoor space. The shaft portion 42 is connected to the drive unit 37. When the controller 33 controls the drive unit 37 to rotate the shaft portion 42, a distal end of the up-and-down vane 41 swings in the up-and-down direction.

FIG. 7 is an illustration of a case in which a room which is the air-conditioning target space is seen from a lateral side. The controller 33 controls the drive unit 37 to set the distal end of the up-and-down vane 41 to any one position among a plurality of positions in the up-and-down direction. In Embodiment 1, the plurality of positions are three positions including an upper side 45, a lower side 47, and a middle 46. The middle 46 is a position between the upper side 45 and the lower side 47. Further, in FIG. 7, a state in which the air-conditioning target space is imaginarily divided into three areas including area y1 to area y3 is illustrated with broken lines. FIG. 7 is an illustration of a case in which, with the air outlet 2*a* serving as a reference, the area y1, the area y2, and the area y3 are sequentially allocated in a direction in which a distance from the air outlet 2*a* increases (Y-axis direction illustrated in FIG. 7). The number of areas into which the air-conditioning target space is divided in the Y-axis direction of the figure, is not limited to three.

In FIG. 7, when the up-and-down vane 41 is at the position of the upper side 45, air which flows into the indoor space through the air outlet 2*a* mainly flows along an arrow 51 illustrated in FIG. 7. In this case, the air mainly flows into the area y1 through the air outlet 2*a*. Further, when the up-and-down vane 41 is at the position of the middle 46, the air which flows into the indoor space through the air outlet 2*a* mainly flows along an arrow 52 illustrated in FIG. 7. In this case, the air mainly flows into the area y2 through the air outlet 2*a*. When the up-and-down vane 41 is at the position of the middle 46, the air which flows into the indoor space through the air outlet 2*a* mainly flows along an arrow 53 illustrated in FIG. 7. In this case, the air mainly flows into the area y1 through the air outlet 2*a*. In such a manner, the controller 33 can set the blowing direction of the air per area, for example, the area y1, the area y2, and the area y3.

In the foregoing, description is made of the case in which one up-and-down vane 41 is provided. However, a plurality of up-and-down vanes 41 may be provided in parallel in the longitudinal direction of the up-and-down vane 41. In this case, intensity of air which flows into each area can be increased. Specific description is made of this feature. When the controller 33 sets the blowing direction of the air to be directed to the area y2, one up-and-down vane 41 of two up-and-down vanes 41 is set to the position of the middle 46. Then, the controller 33 sets an other up-and-down vane 41 to a position of preventing the air which flows out through the air outlet 2*a* from flowing to the area y1. With this configuration, the intensity of the air which flows into the area y2 through the air outlet 2*a* is increased.

Figure 8:
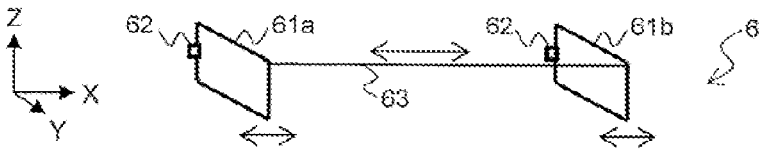
FIG. 8 is a perspective view for illustrating a configuration example of a right-and-left airflow direction adjuster illustrated in FIG. 3.
Figure 9:
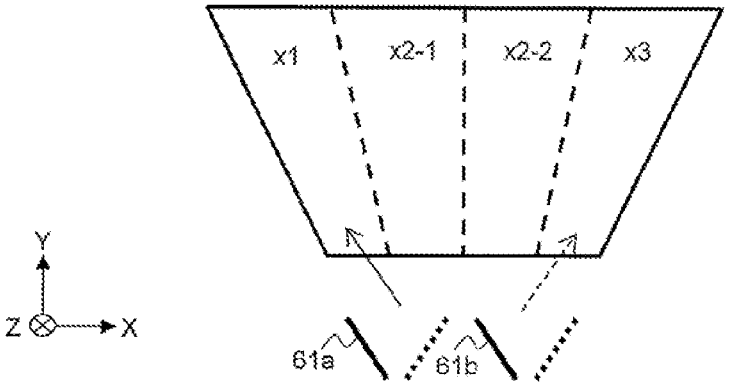
FIG. 9 is an illustration of an example of a case in which an angle of the airflow direction is changed by the right-and-left airflow direction adjuster illustrated in FIG. 8.

FIG. 8 is a perspective view for illustrating a configuration example of the right-and-left airflow direction adjuster illustrated in FIG. 3. FIG. 9 is an illustration of an example of a case in which an angle of the airflow direction is changed by the right-and-left airflow direction adjuster illustrated in FIG. 8. In FIG. 8 and FIG. 9, for ease of description, the configuration is schematically illustrated. The right-and-left airflow direction adjusters 6 provided to the respective air outlets 2*a* to 2*d* each have the same configuration, and hence description is made below with the right-and-left airflow direction adjuster 6 provided to the air outlet 2*a*.

As illustrated in FIG. 8, the right-and-left airflow direction adjuster 6 includes right-and-left vanes 61*a* and 61*b* and a shaft portion 63. The right-and-left vanes 61*a* and 61*b* are each connected by a hinge 62 to a casing (not shown) in the indoor unit 30 illustrated in FIG. 1. As illustrated in FIG. 8, the right-and-left vanes 61*a* and 61*b* are each a plate-like part having a rectangular shape. The shaft portion 63 is mounted to an upper portion of a distal end of each of the right-and-left vanes 61*a* and 61*b* on a distal end side opposite to a distal end side facing the indoor space. The shaft portion 63 is connected to the drive unit 38. The right-and-left vanes 61*a* and 61*b* are connected to each other by the shaft portion 63. Thus, the right-and-left vanes 61*a* and 61*b* operate in association with each other as the shaft portion 63 moves. The controller 33 controls the drive unit 38 to cause the shaft portion 63 to swing in the right-and-left direction, to thereby cause the distal ends of the right-and-left vanes 61*a* and 61*b* to swing in the right-and-left direction. FIG. 8 is an illustration of the case in which two right-and-left vanes are provided. However, the number of right-and-left vanes may be three or more.

FIG. 9 is a schematic illustration of a state in which the air-conditioning target space is seen from the right-and-left airflow direction adjusters illustrated in FIG. 8. In FIG. 9, a state in which the air-conditioning target space is imaginarily divided into four areas including area x1, area x2-1, area x2-2, and area x3 in the horizontal direction, with the air outlet 2*a* serving as a reference, is illustrated with broken lines. Description is made below with the case in which the air-conditioning target space is divided into four areas, but the air-conditioning target space may be divided into three areas including area x1, area x2, and area x3. The number of areas into which the air-conditioning target space is divided in the horizontal direction is not limited to three or four.

The controller 33 controls the drive unit 38 to set the distal ends of the right-and-left vanes 61*a* and 61*b* to any one position among a plurality of positions in the right-and-left direction. In Embodiment 1, the plurality of positions are four positions. With reference to FIG. 9, description is made below of the cases of two positions including a left side position and a right side position among the four positions, and description of two middle positions between the left side position and the right side position is omitted.

In FIG. 9, the case in which the right-and-left vanes 61*a* and 61*b* are each at the left side position is illustrated with the solid lines. When the right-and-left vanes 61*a* and 61*b* each are at the left side position, air which flows into the indoor space through the air outlet 2*a* flows along an arrow illustrated with the solid line. In this case, the air mainly flows into the area x1 through the air outlet 2*a*. Further, in FIG. 9, the case in which the right-and-left vanes 61*a* and 61*b* are each at the right side position is illustrated with broken lines. When the right-and-left vanes 61*a* and 61*b* are each at the right side position, air which flows into the indoor space through the air outlet 2*a* flows along an arrow illustrated with the broken line. In this case, the air mainly flows into the area x3 through the air outlet 2*a*. In such a manner, the controller 33 can set the blowing direction of the air per area, for example, the area x1, the area x2-1, the area x2-2, and the area x3.

Next, with reference to FIG. 5, description is made of contents of control performed by the controller 33. The controller 33 controls a refrigeration cycle in which refrigerant circulates through the refrigerant circuit 25. The controller 33 controls flow paths of the four-way valve 22 in accordance with an operation state of the air-conditioning apparatus 1. Specifically, when the air-conditioning apparatus 1 performs a cooling operation, the controller 33 controls the flow paths of the four-way valve 22 to cause refrigerant discharged from the compressor 21 to flow into the heat source-side heat exchanger 23 and cause refrigerant flowing out from the load-side heat exchanger 7 to return to an intake port side of the compressor 21. When the air-conditioning apparatus 1 performs a heating operation, the controller 33 controls the flow paths of the four-way valve 22 to cause refrigerant discharged from the compressor 21 to flow into the load-side heat exchanger 7 and cause refrigerant flowing out from the heat source-side heat exchanger 23 to return to the intake port side of the compressor 21.

The controller 33 controls an operation frequency of the compressor 21 and an opening degree of the expansion valve 24 so that a measurement value acquired from the temperature measurement unit 5 falls within a range determined for a set temperature. The controller 33 controls the operation frequency of the compressor 21 and the opening degree of the expansion valve 24 so that a measurement value acquired from the humidity measurement unit 10 falls within a range determined for a set humidity.

Further, the controller 33 controls angles of airflow directions of the up-and-down airflow direction adjusters 4*a* to 4*d* and the plurality of right-and-left airflow direction adjusters 6. The memory 35 of the controller 33 stores an area map representing a map of the plurality of areas obtained by imaginarily dividing the air-conditioning target space for each of the air outlets 2*a* to 2*d*. An example of the area map is a combination of the area y1 to the area y3 illustrated in FIG. 7 and the area x1 to the area x3 illustrated in FIG. 9. When an automatic operation is set for the up-and-down airflow direction and the right-and-left airflow direction, the controller 33 controls the up-and-down airflow direction adjusters 4*a* to 4*d* and the plurality of right-and-left airflow direction adjusters 6 to continuously change the angles in the up-and-down direction and the right-and-left direction so that the blowing directions of air are switched per area.

Description has been made of the case in which the controller 33 is provided to the indoor unit 30 with reference to FIG. 1 to FIG. 5. However, the controller 33 may be provided to the outdoor unit 20. Description has been made of the case in which the expansion valve 24 is provided to the outdoor unit 20. However, the expansion valve 24 may be provided to the indoor unit 30. Further, in Embodiment 1, description is made of the case in which the controller 33 performs the airflow direction control for the four air outlets 2*a* to 2*d*, but one air outlet may be subjected to the airflow direction control.

Figure 10:
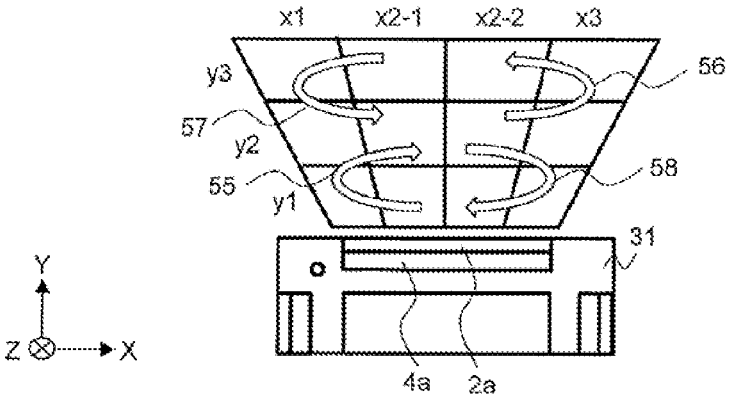
FIG. 10 is an explanatory view for illustrating an airflow direction control method which is performed by the indoor unit for an air-conditioning apparatus according to Embodiment 1 of the present invention.

Next, description is made of operations of the air-conditioning apparatus 1 in Embodiment 1. For ease of description, description is made below of the case of the air-conditioning target space facing the air outlet 2*a*. FIG. 10 is an explanatory view for illustrating an airflow direction control method which is performed by the indoor unit for an air-conditioning apparatus according to Embodiment 1 of the present invention.

As illustrated in FIG. 10, the air-conditioning target space is divided into twelve areas including a combination of the area y1 to the area y3 illustrated in FIG. 7 and the area x1 to the area x3 illustrated in FIG. 9. FIG. 10 is an illustration of an example of the area map of the air-conditioning target space of the air outlet 2*a*. The twelve areas illustrated in FIG. 10 are formed to be divided in a direction in which a distance from the air outlet 2*a* serving as a reference increases and in a direction horizontal to the air outlet 2*a* serving as a reference. Coordinates of the areas illustrated in FIG. 10 are each indicated in a form of (x, y) which is a combination of the area name illustrated in FIG. 9 and the area name illustrated in FIG. 7. Specifically, when the up-and-down vane 41 is at the upper side 45, and the right-and-left vanes 61*a* and 61*b* are each at the left side, a coordinate of an area in the blowing direction of the air is (x1, y3).

The memory 35 of the controller 33 stores, for each of the air outlets 2*a* to 2*d*, coordinates of the areas illustrated in FIG. 10 and control contents for the up-and-down airflow direction adjuster 4*a* and the right-and-left airflow direction adjuster 6. The control contents correspond to information of an angle of the up-and-down vane 41 and an angle of the right-and-left vanes 61*a* and 61*b*. When the automatic operation is set for the up-and-down airflow direction and the right-and-left airflow direction, the controller 33 controls the up-and-down airflow direction adjuster 4*a* and the right-and-left airflow direction adjuster 6 in association with each other so that the blowing direction of the air is switched to areas of the plurality of areas illustrated in FIG. 10. As an example of a method of setting the automatic operation, there is given a method of allowing a user to operate a remote controller (not shown) to input an instruction of the automatic operation to the controller 33. In the following, the operation of switching the blowing direction of the air per area is referred to as "swing operation".

Figure 11:
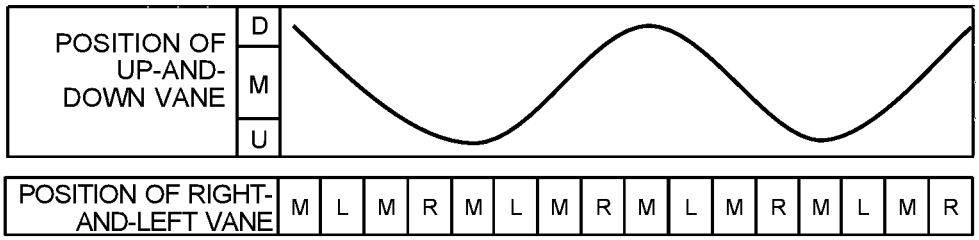
FIG. 11 is an illustration of a procedure of the airflow direction control illustrated in FIG. 10.

Arrows illustrated in FIG. 10 represent an example of switching of an airflow direction in Embodiment 1. FIG. 11 is an illustration of a procedure of the airflow direction control illustrated in FIG. 10. The upper stage in FIG. 11 is an illustration of an order of positions of the up-and-down vane 41 of the up-and-down airflow direction adjuster, and the lower stage in FIG. 11 is an illustration of an order of positions of the right-and-left vanes 61*a* and 61*b* of the right-and-left airflow direction adjuster. In the upper stage in FIG. 11, positions of the up-and-down vane 41 are denoted by "U" indicating the upper side 45, "D" indicating the lower side 47, and "M" indicating the middle 46. In the lower stage in FIG. 11, positions of the right-and-left vanes 61*a* and 61*b* are denoted by "L" indicating the left side and "R" indicating the right side. When the right-and-left vanes 61*a* and 61*b* are at the middle, in the lower stage in FIG. 11, the area x2-1 and the area x2-2 in the blowing direction are integrated, and the integrated positions are each denoted by "M".

When the controller 33 performs a series of control in accordance with the procedure illustrated in FIG. 11 to cause the up-and-down airflow direction adjuster 4*a* and the right-and-left airflow direction adjuster 6 to synchronously operate in association with each other, the blowing direction of the air is switched in the air-conditioning target space in the order indicated by the arrows illustrated in FIG. 10. The series of control corresponds to the procedure from the left end to the right end in FIG. 11. The controller 33 performs the series of control in constant cycles. In one cycle, the blowing direction of the air is switched in the order of arrows 55, 56, 57, and 58 illustrated in FIG. 10. With reference to FIG. 10, in one cycle, a trajectory of the blowing direction of the air to the air-conditioning target space is 8-shaped.

The controller 33 continuously changes the angle of the up-and-down airflow direction adjuster 4*a* and the angle of the right-and-left airflow direction adjuster 6 so that the trajectory of the blowing direction of the air to the plurality of areas is 8-shaped. In this case, as the air-conditioning target space, all of the plurality of areas which the air stream generated from one air outlet 2*a* reaches can be covered, and also a time period in which air blows against one area can be shortened. As a result, the air-conditioning target space which is reduced in temperature unevenness can be provided.

In Embodiment 1, description has been made of the case in which the controller 33 performs the above-mentioned airflow direction control when the instruction of the automatic operation is input. However, a trigger for starting the airflow direction control in Embodiment 1 is not limited to the input by a user. For example, in a case in which the operation state of the air-conditioning apparatus 1 is the cooling operation, the controller 33 may start the above-mentioned airflow direction control when the temperature measured by the temperature measurement unit 5 does not fall within the range determined for the set temperature. Further, in the case in which the operation state of the air-conditioning apparatus 1 is the cooling operation, the controller 33 may start the above-mentioned airflow direction control when the humidity measured by the humidity measurement unit 10 does not fall within the range determined for the set humidity.

The indoor unit 30 for the air-conditioning apparatus 1 according to Embodiment 1 controls the up-and-down airflow direction adjuster 4*a* and the right-and-left airflow direction adjuster 6 to continuously change the angle in the up-and-down direction and the angle of the right-and-left direction so that the blowing direction of the air is switched to areas of the plurality of areas of the air-conditioning target space.

According to Embodiment 1, the indoor unit 30 continuously changes the up-and-down airflow direction and the right-and-left airflow direction to the air-conditioning target space divided into the plurality of areas, to thereby switch the blowing direction of the air to areas of the plurality of areas. Consequently, the air-conditioning target space can be evenly air-conditioned. As a result, in the air-conditioning target space, the temperature unevenness is reduced, thereby improving comfortability of a user. The airflow rate becomes more even in the entirety of the air-conditioning target space, thereby reducing the draft feeling giving feeling of discomfort to a user.

In Embodiment 1, when the controller 33 performs the above-mentioned control over the up-and-down airflow direction adjusters 4*a* to 4*d* and the right-and-left airflow direction adjusters 6 at the four air outlets 2*a* to 2*d*, the entire room can be evenly air-conditioned. The temperature unevenness in the entire room is reduced, thereby reducing the draft feeling giving feeling of discomfort to a user anywhere in the room.

In Embodiment 1, there are formed the plurality of areas which are obtained by dividing the air-conditioning target space in the direction in which the distance from the air outlet 2*a* serving as a reference increases and the direction horizontal to the air outlet 2*a*. The air-conditioning target space is divided into the plurality of areas not only in the horizontal direction but also in a distance from the air outlet 2*a*. Consequently, when the controller 33 performs the control of switching the blowing direction of the air per area, finer air-conditioning setting can be achieved.

Embodiment 2

The air-conditioning apparatus in Embodiment 1 causes the up-and-down airflow direction adjusters 4*a* to 4*d* and the plurality of right-and-left airflow direction adjusters 6 to operate in association with each other to eliminate the temperature unevenness in the air-conditioning target space, thereby reducing the draft feeling of a user. The air-conditioning apparatus in Embodiment 2 of the present invention provides the air-conditioning target space which is further reduced in temperature unevenness in the case of the heating operation.

The configuration of the air-conditioning apparatus in Embodiment 2 is the same as the configuration of the air-conditioning apparatus 1 described in Embodiment 1, and hence description of the configuration is omitted in Embodiment 2. During the heating operation, warm air blown out from the indoor unit 30 of the air-conditioning apparatus 1 is liable to stagnate on a ceiling surface, with the result that there is given a state of being hot on a head side and cold on a feet side. As an example of a method for preventing such a state, an operation of the air-conditioning apparatus 1 in Embodiment 2 is described. Description is made below of the operation of the air-conditioning apparatus 1 in the case of the airflow direction control for the air outlet 2*a*.

Figure 12:
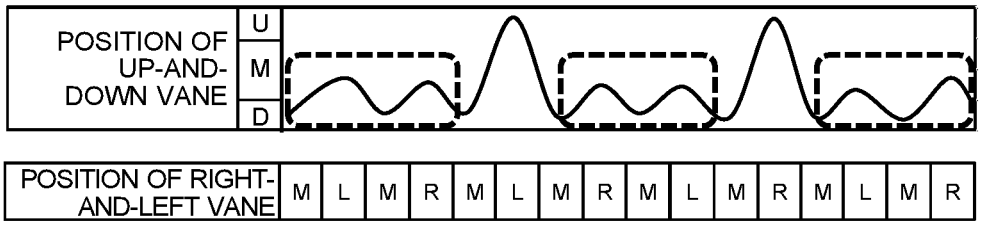
FIG. 12 is an illustration of a procedure of airflow direction control performed by an indoor unit for an air-conditioning apparatus according to Embodiment 2 of the present invention.

FIG. 12 is an illustration of a procedure of the airflow direction control performed by the indoor unit for the air-conditioning apparatus according to Embodiment 2 of the present invention. The upper stage in FIG. 12 is an illustration of an order of positions of the up-and-down vane 41 of the up-and-down airflow direction adjuster, and the lower stage in FIG. 12 is an illustration of an order of positions of the right-and-left vanes 61*a* and 61*b* of the right-and-left airflow direction adjuster.

In the order illustrated in the upper stage in FIG. 12, as indicated by broken line frames, there are regions in which the up-and-down vane 41 is frequently at the position of the lower side 47. Meanwhile, as illustrated in the lower stage in FIG. 12, the right-and-left vanes 61*a* and 61*b* perform the swing operation of switching the blowing direction of the air per area to be directed to the plurality of areas divided in the direction horizontal to the air outlet 2*a* serving as a reference. According to comparison of the broken line frames in the upper stage in FIG. 12 and the lower stage in FIG. 12, when the right-and-left vanes 61*a* and 61 cause the blowing direction of the air to be directed to the area x2 at the middle M, a position of the up-and-down vane 41 is at the lower side 47.

As described above with reference to FIG. 12, when the heating operation is performed, under a state in which the right-and-left airflow direction adjuster 6 is controlled to perform the swing operation, the controller 33 performs control over the up-and-down airflow direction adjuster 4*a* to increase the ratio of time of causing the blowing direction of the air to be directed to the lower side 47. In the procedure illustrated in FIG. 12, the controller 33 controls the up-and-down airflow direction adjuster 4*a* so that the blowing direction of the air is directed to the lower side when the right-and-left airflow direction adjuster 6 is positioned at the middle.

The controller 33 performs the control of causing the up-and-down airflow direction to be directed to the lower side when the right-and-left airflow direction is positioned at the middle. With this control, warm air is likely to reach feet of a user who is in the indoor space, thereby being capable of reducing the temperature unevenness in the up-and-down direction in the indoor space. When the air-conditioning apparatus 1 performs the heating operation, the blowing direction of the air is caused to swing in the right-and-left direction, and the ratio of time of causing the up-and-down direction to be directed downward is increased. With this control, stagnation of heat on the ceiling side is prevented, thereby being capable of evenly air-conditioning the entire room. Further, when the controller 33 performs control of causing the airflow rate to be highest when the right-and-left airflow direction is positioned at the middle, improvement in effect of reducing the temperature unevenness in the up-and-down direction in the indoor space can be expected.

In the indoor unit 30 for the air-conditioning apparatus 1 according to Embodiment 2, when the heating operation is performed, in the entire time for switching the blowing direction of the air to be directed to the area y1 to the area y3 with the air outlet 2*a* serving as a reference, the ratio of time for the area y1 is set larger than the ratio of time for the other area y2 and the other area y3.

According to Embodiment 2, when the air-conditioning apparatus 1 performs the heating operation, with regard to the blowing direction of the air, control is performed to increase the ratio toward the lower side in the up-and-down direction and cause the blowing direction of the air to swing in the right-and-left direction, thereby being capable of evenly air-conditioning the air-conditioning target space. As a result, in the air-conditioning target space, the temperature unevenness in the up-and-down direction is addressed, thereby being capable of achieving both comfortability and energy-saving performance. The air-conditioning apparatus 1 performs control similar to the above-mentioned control at the four air outlets 2*a* to 2*d*, thereby being capable of evenly air-conditioning the room. As a result, the temperature unevenness in the up-and-down direction in the indoor space is reduced, thereby being capable of achieving both the comfortability and energy-saving performance.

Embodiment 3

The air-conditioning apparatus in Embodiments 1 and 2 cause the up-and-down airflow direction adjusters 4*a* to 4*d* and the plurality of right-and-left airflow direction adjusters 6 to operate in association with each other to reduce the temperature unevenness in the air-conditioning target space, to thereby improve the comfortability of a user. An air-conditioning apparatus in Embodiment 3 of the present invention includes a human body position detection unit configured to detect a position at which a person is present in the air-conditioning target space, and is configured to perform control of automatically causing the air to be blown against a person. There is difference in sensible temperature depending on a person, and hence Embodiment 3 is suitable for a person who desires air from the air-conditioning apparatus to be blown.

Description is made of a configuration of the air-conditioning apparatus in Embodiment 3. In Embodiment 3, detailed description of the configurations similar to those of Embodiments 1 and 2 is omitted, and features different from those of Embodiments 1 and 2 are described in detail.

Figure 13:
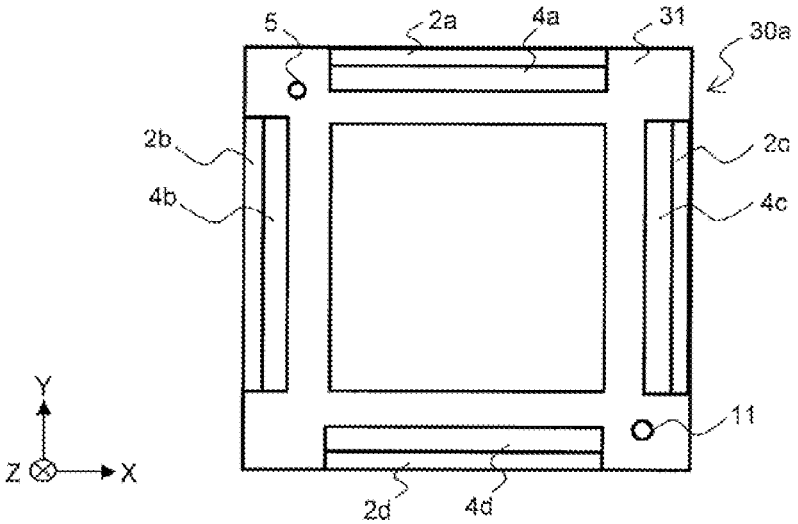
FIG. 13 is a plan view of an indoor unit for an air-conditioning apparatus according to Embodiment 3 of the present invention as seen from a lower surface side.
Figure 14:
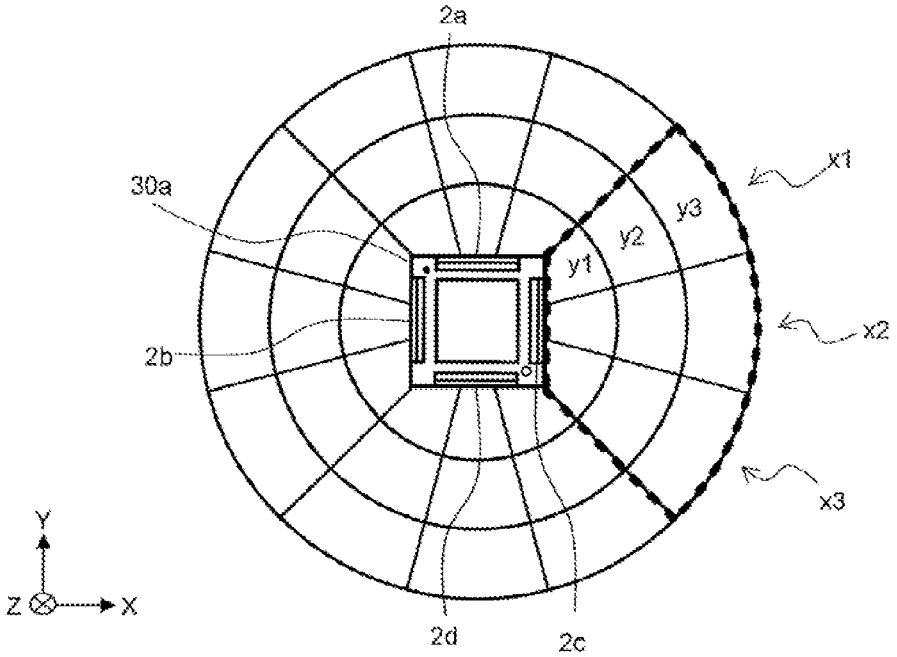
FIG. 14 is a schematic view for illustrating an example of a case in which, in the air-conditioning apparatus in Embodiment 3 of the present invention, an air-conditioning target space is divided into a plurality of areas.

FIG. 13 is a plan view of an indoor unit for an air-conditioning apparatus according to Embodiment 3 of the present invention as seen from a lower surface side. FIG. 14 is a schematic view for illustrating an example of a case in which the air-conditioning target space is divided into a plurality of areas with the air-conditioning apparatus in Embodiment 3 of the present invention.

As illustrated in FIG. 13, a human body position detection unit 11 is provided to a lower surface 31 of an indoor unit 30*a*. In the indoor unit 30*a* illustrated in FIG. 13, the human body position detection unit 11 is provided at a position diagonal to the temperature measurement unit 5 on the lower surface 31. The position at which the human body position detection unit 11 is provided is not limited to the position illustrated in FIG. 13. The controller 33 is connected to the human body position detection unit 11 by a signal line. In Embodiment 3, the human body position detection unit 11 is an infrared sensor.

As illustrated in FIG. 14, the air-conditioning target space of each of the air outlets 2*a* to 2*d* of the indoor unit 30*a* is divided into nine areas. The broken line frame illustrated in FIG. 14 indicates the nine areas of the air-conditioning target space at the air outlet 2*c*. The entirety of the air-conditioning target space by the indoor unit 30*a* is divided into 9×4=36 areas. The memory 35 of the controller 33 stores the area map illustrated in FIG. 14.

The human body position detection unit 11 measures a radiation temperature for each position specified by a distance from a reference position and an azimuth angle set for the indoor unit 30*a*. There is an advantage in that the measurement accuracy increases as intervals of the positions specified by the distance from the reference position and the azimuth angle are finer. However, there is a disadvantage in that time required for measurement increases. In Embodiment 1, the human body position detection unit 11 measures radiation temperatures at a plurality of positions for each of the areas illustrated in FIG. 14. In Embodiment 1, increase in time required for measurement is reduced by setting the measurement region pert area. Further, degradation in measurement accuracy is prevented by performing measurement at a plurality of positions in each area.

As an example of a measurement method for the radiation temperature, description is made of the case of the air-conditioning target space at the air outlet 2*c*. The human body position detection unit 11 measures radiation temperatures in the area x1 at a plurality of positions in each area in the order of (x1, y1), (x1, y2), and (x1, y3). Subsequently, similarly to the case of the area x1, the human body position detection unit 11 measures radiation temperatures at a plurality of positions in each area in the order of the area x2 and the area x3.

When an instruction to activate is received from the controller 33, the human body position detection unit 11 measures radiation temperatures at a plurality of positions for each of thirty-six areas. The human body position detection unit 11 outputs, to the controller 33, radiation temperature data including a pair of information of the areas subjected to measurement and radiation temperatures at a plurality of positions measured in the areas subjected to measurement.

When the radiation temperature data is received from the human body position detection unit 11, the controller 33 compares the radiation temperature data with the area map illustrated in FIG. 14, and generates human body position distribution indicating whether or not a person is present per area. The controller 33 refers to the generated human body position distribution, and controls the up-and-down airflow direction adjusters 4*a* to 4*d* and the plurality of right-and-left airflow direction adjusters 6 to operate in association with each other so that the blowing direction of the air is switched per area among the plurality of areas for which the human body position detection unit has detected presence of a person.

The human body position detection unit 11 is provided at a corner portion of the lower surface 31 of the indoor unit 30*a*. However, the positions of the areas of the radiation temperature data received by the controller 33 from the human body position detection unit 11 are corrected to positions with the center of the indoor unit 30*a* as a reference as illustrated in FIG. 14. Description is made of an example of a determination method for the presence or absence of a person in each area. The controller 33 calculates an average value of the plurality of radiation temperatures included in the radiation temperature data. When the average value is equal to or larger than a threshold value, it is determined that a person is present in the area subjected to the determination. When the average value is smaller than the threshold value, it is determined that a person is absent in the area subjected to the determination. This threshold value is a value which serves as a reference for indicating whether or not the measurement value of the radiation temperature is a temperature caused by radiation heat radiated from a human body. This threshold value is stored in the memory 35. In the following, among the plurality of areas, an area in which a person is present is referred to as "person-present area", and an area in which a person is absent is referred to as "person-absent area".

Figure 15:
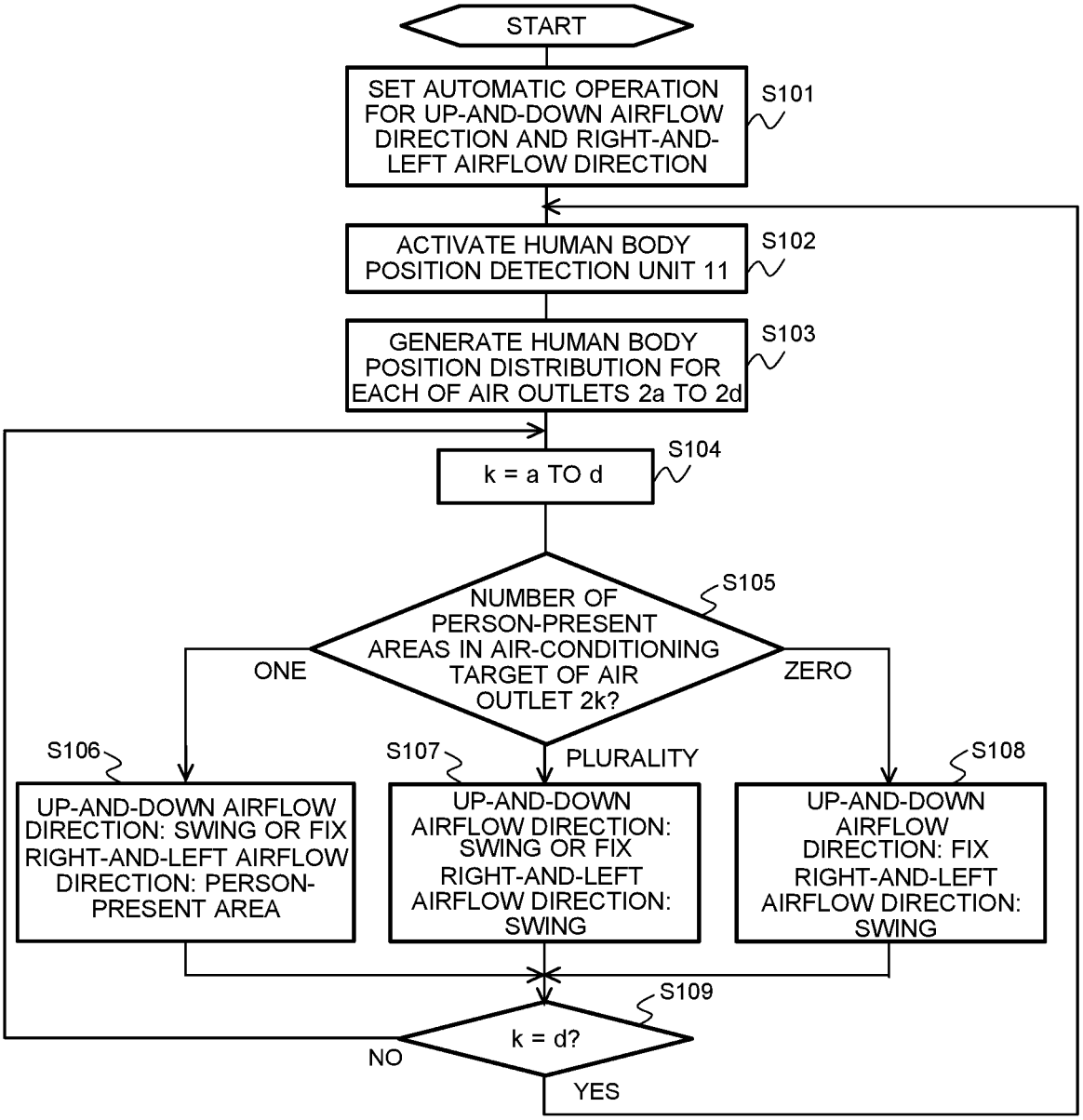
FIG. 15 is a flowchart for illustrating a procedure of airflow direction control performed by the indoor unit for an air-conditioning apparatus according to Embodiment 3 of the present invention.
Figure 16:
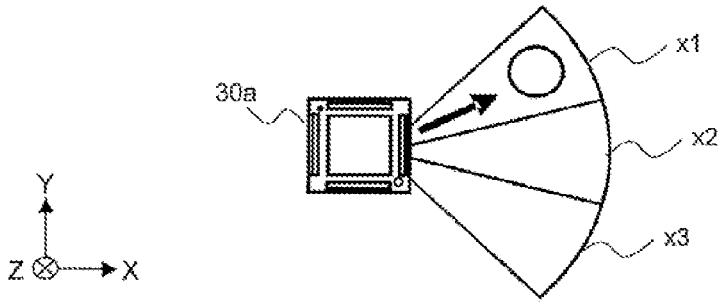
FIG. 16 is an illustration of a case in which one person-present area is present among the plurality of areas in Embodiment 3 of the present invention.
Figure 17:
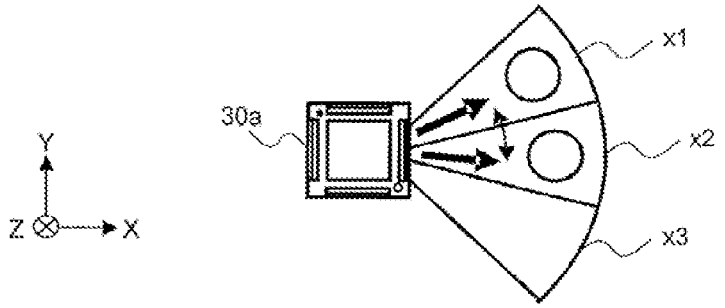
FIG. 17 is an illustration of a case in which two person-present areas are present among the plurality of areas in Embodiment 3 of the present invention.
Figure 18:
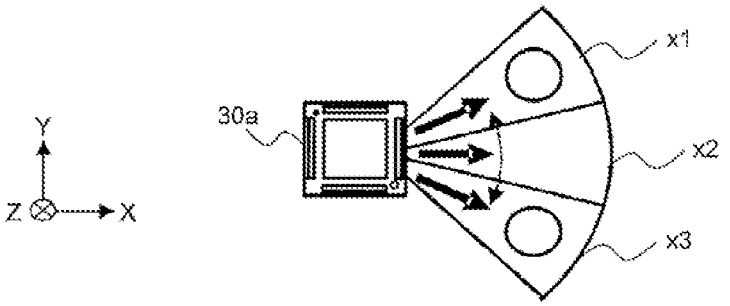
FIG. 18 is an illustration of a case in which a person-absent area is sandwiched between two person-present areas in Embodiment 3 of the present invention.

Next, description is made of an operation of the air-conditioning apparatus in Embodiment 3. FIG. 15 is a flowchart for illustrating a procedure of airflow direction control performed by the indoor unit for the air-conditioning apparatus according to Embodiment 3 of the present invention. FIG. 16 to FIG. 18 are views for illustrating an example of a case in which the person-present area differs in the air-conditioning target space of the air-conditioning apparatus in Embodiment 3 of the present invention. In FIG. 16 to FIG. 18, a position of a person is indicated by a circle. In FIG. 16 to FIG. 18, for ease of description, each area is not divided into the area y1 to the area y3.

As illustrated in FIG. 15, when an instruction to set the automatic operation to the up-and-down airflow direction and the right-and-left airflow direction is input (Step S101), the controller 33 activates the human body position detection unit 11 (Step S102). When the radiation temperature data for each area is collected from the human body position detection unit 11, the controller 33 generates human body position distribution for the air-conditioning target space of each of the air outlets 2*a* to 2*d* (Step S103). In Step S104 to Step S109, the controller 33 performs determination in Step S105 for each of the air outlets 2*a* to 2*d*, and performs processing of any one of Step S106 to Step S108 in accordance with a determination result. With reference to FIG. 16 to FIG. 18, description is made of the operation in the case of the air outlet 2*c*.

FIG. 16 is an illustration of a case in which one person-present area is present among the plurality of areas in Embodiment 3 of the present invention. In the case illustrated in FIG. 16, in accordance with a result given in Step S105, the controller 33 proceeds to the processing of Step S106. The controller 33 causes the airflow direction of the up-and-down airflow direction adjuster 4*c* to swing, to thereby cause the airflow direction of the right-and-left airflow direction adjuster 6 to be directed to the person-present area x1 (Step S106). In Step S106, in a case of controlling the blowing direction of the air per area also with regard to the area y1 to the area y3 illustrated in FIG. 14, the controller 33 may cause the airflow direction of the up-and-down airflow direction adjuster 4*c* to be fixed to the person-present area. In this case, the right-and-left direction of the blowing direction of the air is fixed to the person-present area x1, and the up-and-down direction is caused to swing or fixed to the person-present area, thereby being capable of automatically sending air to a person.

FIG. 17 is an illustration of a case in which two person-present areas are present among the plurality of areas in Embodiment 3 of the present invention. In the case illustrated in FIG. 17, in accordance with the result given in Step S105, the controller 33 proceeds to the processing of Step S107. The controller 33 causes the airflow direction of the up-and-down airflow direction adjuster 4*c* to swing, to thereby cause the airflow direction of the right-and-left airflow direction adjuster 6 to swing between the person-present area x1 and the person-present x2 (Step S107). In Step S107, in the case of controlling the blowing direction of the air per area also with regard to the area y1 to area y3, the controller 33 may cause the airflow direction of the up-and-down airflow direction adjuster 4*c* to be fixed to the person-present area. In this case, the right-and-left direction of the blowing direction of the air is caused to swing to the person-present areas x1 and the person-present area x2, and the up-and-down direction is caused to swing or fixed to the person-present areas, thereby being capable of automatically sending air to a person.

FIG. 18 is an illustration of a case in which a person-absent area is sandwiched between two person-present areas in Embodiment 3 of the present invention. In the case illustrated in FIG. 18, in accordance with the result given in Step S105, the controller 33 proceeds to the processing of Step S107. The controller 33 causes the airflow direction of the up-and-down airflow direction adjuster 4*c* to swing, to thereby cause the airflow direction of the right-and-left airflow direction adjuster 6 to swing between the person-present area x1 and area x3 (Step S107). In Step S107, in the case of controlling the blowing direction of the air per area also with regard to the area y1 to area y3, the controller 33 may cause the airflow direction of the up-and-down airflow direction adjuster 4*c* to be fixed to the person-present area. In this case, the right-and-left direction of the blowing direction of the air is caused to swing to the person-present area x1 to area x2, and the up-and-down direction is caused to swing or fixed to the person-present areas, thereby being capable of automatically sending air to a person.

In the determination in Step S105 illustrated in FIG. 15, when the person-present area is not detected, the controller 33 fixes the airflow direction of the up-and-down airflow direction adjuster 4*c*, and causes the airflow direction of the right-and-left airflow direction adjuster 6 to swing (Step S108). Description is made of the reason why the controller 33 causes the right-and-left airflow direction adjuster 6 to perform the swing operation even though the person-present area is not detected in the air-conditioning target space. The temperature in the air-conditioning target space of the air outlet 2*c* is set to be even. Consequently, when a user moves from the air-conditioning target space of an other air outlet 2*a*, 2*b*, or 2*d* to the air-conditioning target space of the air outlet 2*c*, the user is not caused to feel uncomfortable.

Further, in Step S108, when the airflow direction of the up-and-down airflow direction adjuster 4*c* is to be fixed, the controller 33 may fix the airflow direction of the up-and-down airflow direction adjuster 4*c* in a direction which is the same as that of the up-and-down airflow direction adjuster at any one of the air outlets 2*a* and 2*d* adjacent to the air outlet 2*c*. In this case, when a user is present in the air-conditioning target space of any of the air outlets 2*a* and 2*d*, the evenness in temperature is improved in a band-like area in a coaxial circle about the indoor unit 30*a* as a center of the circle. For example, when a user is present in the area y2 of the air-conditioning target space of the air outlet 2*a*, evenness in temperature in areas y2 of the air-conditioning target spaces of the air outlets 2*a* and 2*c* is improved.

In the procedure illustrated in FIG. 15, when the controller 33 performs control of switching the blowing direction of the air per person-present area to be directed to the air-conditioning target spaces of all of the air outlets 2*a* to 2*d* (Step S109), the processing returns to Step S102. The controller 33 repeats the processing of Step S102 to Step S109 at constant cycles, and hence, even when a user moves in the indoor space, the control of switching the blowing direction of the air to be directed to an area of a destination of the user can be continued.

In Embodiment 3, description has been made of the case in which the human body position detection unit 11 outputs, to the controller 33, the radiation temperature data including the pair of information of the areas subjected to measurement and the radiation temperatures at the plurality of positions measured in the areas subjected to measurement. However, information indicating whether or not a person is present may be used in place of the radiation temperature. In this case, the human body position detection unit 11 outputs, to the controller 33, human body presence-absence data including the pair of information of the areas subjected to measurement and the information indicating whether or not a person is present in the area subjected to measurement. It is only required that the controller 33, after receiving the human body presence-absence data from the human body position detection unit 11, compare the human body presence-absence data with the area map and generate human body position distribution indicating whether or not a person is present per area.

In the indoor unit 30*a* for the air-conditioning apparatus 1 according to Embodiment 3, the controller 33 controls the up-and-down airflow direction adjusters 4*a* to 4*d* and the right-and-left airflow direction adjusters 6 to operate in association with each other, to thereby cause the blowing direction of the air to be directed to an area detected by the human body position detection unit 11 that a person is present among the plurality of areas of the air-conditioning target space.

According to Embodiment 3, the controller 33 specifies a person-present area from among the plurality of areas in the air-conditioning target space and performs the control of associating the up-and-down airflow direction and the right-and-left airflow direction with each other for the person-present area, thereby being capable of automatically blowing air against the area in which a person is present. As a result, air can automatically be blown against a person. Further, comfortability of a person who requests air to be blown from the air-conditioning apparatus is improved. Through the operation of preventing air from being blown against an area in which a person is not present, energy-saving performance is improved.

Embodiment 4

The air-conditioning apparatus in Embodiment 3 is configured to perform control of specifying a position of a human body and automatically blowing air against a person, in addition to the control of causing the up-and-down airflow direction adjusters 4*a* to 4*d* and the plurality of right-and-left airflow direction adjusters 6 to operate in association with each other. An air-conditioning apparatus in Embodiment 4 of the present invention is configured to automatically control the airflow direction so that air is not blown against a person who is in the air-conditioning target space. There is difference in sensible temperature depending on a person, and hence Embodiment 4 is suitable for a person who feels uncomfortable when air is directly blown from the air-conditioning apparatus.

The air-conditioning apparatus in Embodiment 4 is different from the air-conditioning apparatus described in Embodiment 3 only in control method. Consequently, description of a configuration of the air-conditioning apparatus in Embodiment 4 is omitted.

Figure 19:
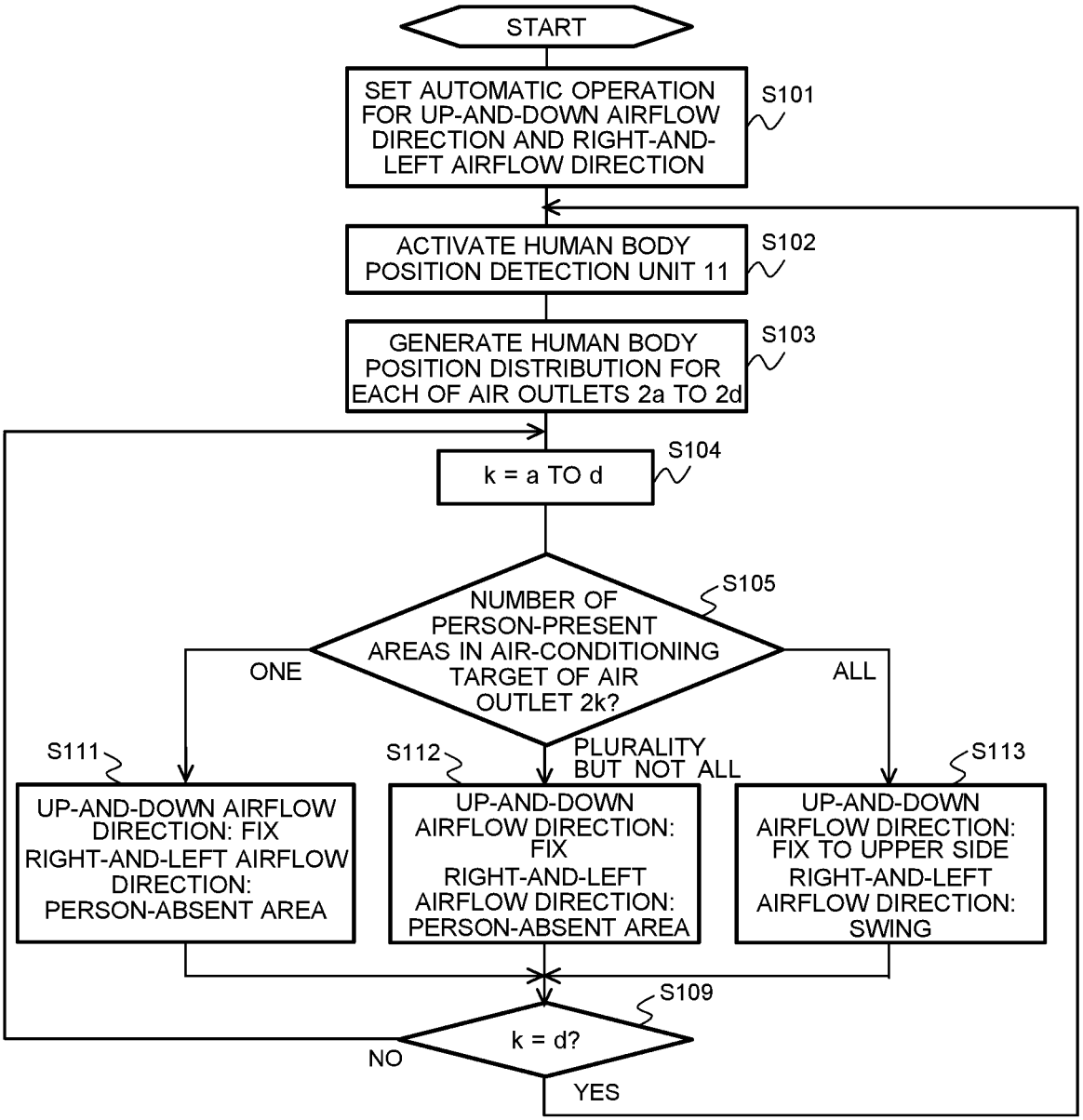
FIG. 19 is a flowchart for illustrating a procedure of airflow direction control performed by an indoor unit for an air-conditioning apparatus according to Embodiment 4 of the present invention.
Figure 20:
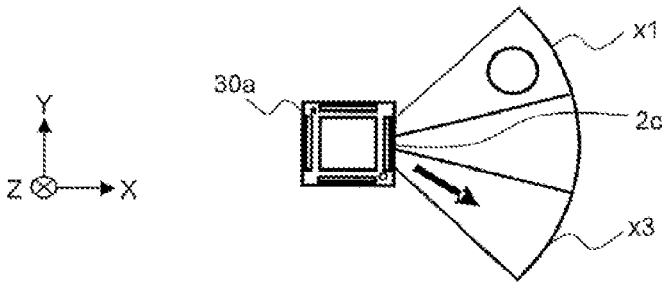
FIG. 20 is an illustration of a case in which one person-present area is present among a plurality of areas in Embodiment 4 of the present invention.
Figure 21:
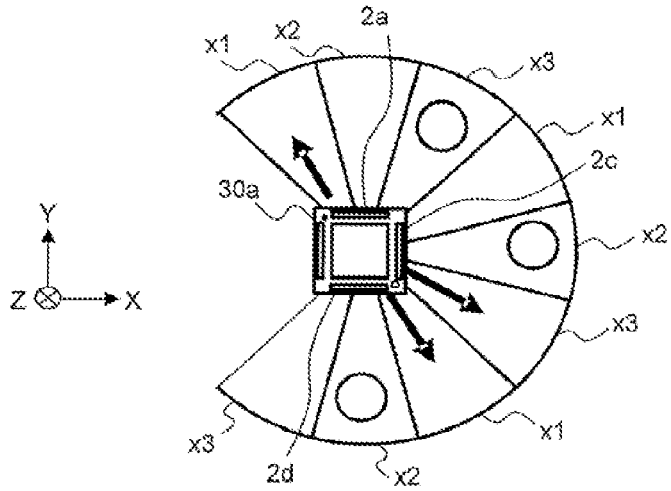
FIG. 21 is a collective illustration of presence or absence of person-present areas among a plurality of areas for each of three air outlets in Embodiment 4 of the present invention.
Figure 22:
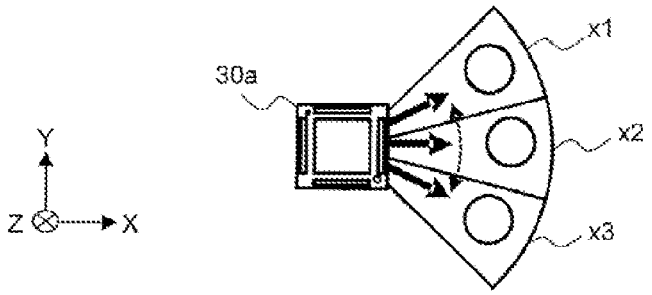
FIG. 22 is an illustration of a case in which no person-absent area is present among the plurality of areas in Embodiment 4 of the present invention.

Description is made of an operation of the air-conditioning apparatus in Embodiment 4. FIG. 19 is a flowchart for illustrating a procedure of airflow direction control performed by the indoor unit for the air-conditioning apparatus according to Embodiment 4 of the present invention. FIG. 20 to FIG. 22 are views for illustrating an example of a case in which the person-present area differs in the air-conditioning target space of the air-conditioning apparatus in Embodiment 4 of the present invention. In FIG. 20 to FIG. 22, a position of a person is indicated by a circle. In FIG. 20 to FIG. 22, for ease of description, each area is not divided into the area y1 to the area y3. Further, in Embodiment 4, Step S101 to Step S105 of the procedure illustrated in FIG. 19 are the same as the processing described with reference to FIG. 15, and hence detailed description of the same processing is omitted.

In Step S103 illustrated in FIG. 19, the controller 33 generates human body position distribution in the air-conditioning target space of each of the air outlets 2*a* to 2*d*. Then, the controller 33 performs the determination in Step S105 for each of the air outlets 2*a* to 2*d*, and performs the processing of any one of Step S111 to Step S113 in accordance with a determination result. With reference to FIG. 20 to FIG. 22, description is mainly made of the operation in the case of the air outlet 2*c*.

FIG. 20 is an illustration of a case in which one person-present area is present among the plurality of areas in Embodiment 4 of the present invention. In the case illustrated in FIG. 20, as a result of Step S105, the controller 33 proceeds to the processing of Step S111. The controller 33 fixes the airflow direction of the up-and-down airflow direction adjuster 4*c* to the upper side or the person-absent area, and causes the airflow direction of the right-and-left airflow direction adjuster 6 to be directed to the person-absent area (Step S111).

In the example illustrated in FIG. 20, illustration is given of the case in which the controller 33 causes the airflow direction of the right-and-left airflow direction adjuster 6 to be directed to the person-absent area x3 among the person-absent the area x2 and the area x3. In this case, the person-absent area x2 is present between the area x3 being the blowing direction of the air and the person-present area x1, and hence air is sent to the area x3 apart from the person-present area x1. As a result, the draft feeling of a user who is in the area x1 can further be reduced.

In such a manner, the right-and-left direction of the blowing direction of the air is fixed to the person-absent area x3, and the up-and-down direction is fixed, thereby being capable of automatically preventing air from being blown against a user. As a result of determination in Step S105, even when a plurality of person-present areas are present, and a person-absent area is present, the controller 33 fixes the airflow direction of the up-and-down airflow direction adjuster 4*c* to the upper side or the person-absent area, and causes the airflow direction of the right-and-left airflow direction adjuster 6 to be directed to the person-absent area (Step S112). In this case, the effect similar to that of the case of Step S111 can be obtained.

When the airflow direction control for the air outlet 2*c* is to be performed, the controller 33 may refer to a person-present area in the air-conditioning target space of each of the outlets 2*a* and 2*d* adjacent to the air outlets 2*c*. Description is made of this case with reference to FIG. 21. FIG. 21 is a collective illustration of presence or absence of a person-present area among the plurality of areas for each of three outlets in Embodiment 4 of the present invention. In Step S103 illustrated in FIG. 19, the controller 33 generates human body position distribution for each of the air outlets 2*a* to 2*d* and stores the same in the memory 35. The human body position distribution given in this case is illustrated in FIG. 21. However, in FIG. 21, illustration of the human body position distribution for the air outlet 2*b* is omitted.

FIG. 21 is an illustration of a case in which, with regard to the air-conditioning target space of the air outlet 2*a*, the area x3 is a person-present area, and the area x1 and the area x2 are person-absent areas. Further, FIG. 21 is an illustration of a case in which, with regard to the air-conditioning target space of the air outlet 2*c*, the area x2 is a person-present area, and the area x1 and the area x3 are person-absent areas. FIG. 21 is an illustration of a case in which, with regard to the air-conditioning target space of the air outlet 2*d*, the area x2 is a person-present area, and the area x1 and the area x3 are person-absent areas.

As a result of determination in Step S105 with regard to the air outlet 2*c*, when the controller 33 determines that one person-present area is present, the controller 33 fixes the airflow direction of the up-and-down airflow direction adjuster 4*c* to the upper side or the person-absent area, and causes the airflow direction of the right-and-left airflow direction adjuster 6 to be directed to the person-absent area (Step S111). It is conceivable that, in Step S111, the controller 33 selects any one of the area x1 and the area x3 when the airflow direction of the right-and-left airflow direction adjuster 6 is to be directed to the person-absent area. In this case, the controller 33 refers to the human body position distribution illustrated in FIG. 21, to thereby determine that the area x3 of the air outlet 2*a* is a person-present area, whereas the area x1 of the air outlet 2*d* is a person-absent area. Only one person-absent area is present between the person-present area x2 of the air outlet 2*c* and the person-present area x3 of the air outlet 2*a*, but two person-absent areas are present between the person-present area x2 of the air outlet 2*c* and the person-present area x2 of the air outlet 2*d*. In this case, the controller 33 selects the area x3 from the area x1 and the area x3 of the air outlet 2*c* as a destination of the airflow direction of the right-and-left airflow direction adjuster 6.

In such a manner, when the airflow direction control for the air outlet 2*c* is to be performed, the controller 33 selects the blowing direction of the air to be directed to the area in which a ratio of presence of a person is smallest on the basis of not only the human body position distribution of the air outlet 2*c* but also the human body position distribution of the adjacent air outlets 2*a* and 2*d*. As a result, air is sent from the indoor unit 30 to the area in which the ratio of presence of a person is smallest, thereby being capable of preventing air from being directly blown against a user.

FIG. 22 is an illustration of a case in which the person-absent area is not present among the plurality of areas in Embodiment 4 of the present invention. In Step S105 illustrated in FIG. 19, when it is determined that the person-absent area is zero, the controller 33 proceeds to the processing of Step S113. The controller 33 fixes the airflow direction of the up-and-down airflow direction adjuster 4*c* to the upper side, and causes the airflow direction of the right-and-left airflow direction adjuster 6 to swing (Step S113). FIG. 22 is an illustration of a case in which the controller 33 causes the airflow direction of the right-and-left airflow direction adjuster 6 to swing among the area x1 to the area x3. In this case, the airflow direction of the up-and-down airflow direction adjuster 4*c* is directed to the upper side, and hence the air sent from the air outlet 2*c* flows along the ceiling, thereby being capable of preventing air from being directly blown against a user. Further, the airflow direction of the right-and-left airflow direction adjuster 6 swings, and hence the flow of air is diffused, thereby being capable of preventing air from being intensively blown against one area.

As described above with reference to FIG. 20 to FIG. 22, the controller 33 fixes the airflow direction of the up-and-down airflow direction adjuster 4*c* to the upper side or the person-absent area, and causes the airflow direction of the right-and-left airflow direction adjuster 6 to be directed to the person-absent area apart from the person-present area, thereby being capable of preventing air from being blown against a user.

In the indoor unit 30*a* for the air-conditioning apparatus 1 according to Embodiment 4, the controller 33 controls the up-and-down airflow direction adjusters 4*a* to 4*d* and the right-and-left airflow direction adjusters 6 to operate in association with each other, to thereby cause the blowing direction of the air to be directed to an area which is detected by the human body position detection unit 11 that a person is absent among the plurality of areas of the air-conditioning target space.

According to Embodiment 4, the controller 33 specifies a person-absent area from the plurality of areas of the air-conditioning target space and performs the control of causing the up-and-down airflow direction and the right-and-left air flow direction to operate in association with each other for the person-absent area, thereby being capable of automatically causing air to be blown against an area in which a person is absent. As a result, air can be automatically prevented from being directly blown against a person. Further, for a person who feels uncomfortable by air being directly blown from the air-conditioning apparatus, the draft feeling is reduced, and comfortability is improved.

Embodiment 5

The air-conditioning apparatus in Embodiments 3 and 4 are configured to perform control of specifying a position of a human body and send air to a person or prevent air from being sent to the person, in addition to the control of causing the up-and-down airflow direction adjusters 4*a* to 4*d* and the plurality of right-and-left airflow direction adjusters 6 to operate in association with each other. An air-conditioning apparatus in Embodiment 5 of the present invention is configured to automatically detect temperature unevenness in the air-conditioning target space and provide an air-conditioned space with even temperature and without temperature unevenness.

Description is made of a configuration of the air-conditioning apparatus in Embodiment 5. In Embodiment 5, detailed description of the configurations similar to those of Embodiments 1 to 3 is omitted, and features different from those of Embodiments 1 to 3 are described in detail.

Figure 23:
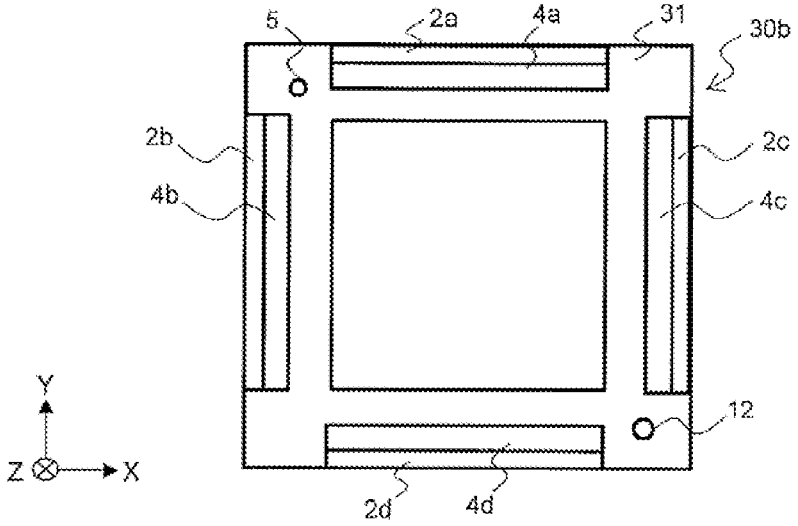
FIG. 23 is a plan view of an indoor unit for an air-conditioning apparatus according to Embodiment 5 of the present invention as seen from a lower surface side.

FIG. 23 is a plan view of an indoor unit for an air-conditioning apparatus according to Embodiment 5 of the present invention as seen from a lower surface side. As illustrated in FIG. 23, a radiation temperature measurement unit 12 is provided on the lower surface 31 of an indoor unit 30*b*. In the indoor unit 30*b* illustrated in FIG. 23, the radiation temperature measurement unit 12 is provided on the lower surface 31 at a position diagonal to the temperature measurement unit 5. The position at which the radiation temperature measurement unit 12 is provided is not limited to the position illustrated in FIG. 13. The controller 33 is connected to the radiation temperature measurement unit 12 by a signal line. In Embodiment 5, the radiation temperature measurement unit 12 is an infrared sensor.

Also with regard to the indoor unit 30*b* of Embodiment 5, as described above with reference to FIG. 14, the air-conditioning target space of each of the air outlets 2*a* to 2*d* is divided into nine areas. The radiation temperature measurement unit 12 measures a radiation temperature of a floor for each position specified by a distance form a reference position and an azimuth angle which are set for the indoor unit 30*b*. In Embodiment 5, the radiation temperature measurement unit 12 measures radiation temperatures at a plurality of positions for each area illustrated in FIG. 14. When an instruction to activate is received from the controller 33, the radiation temperature measurement unit 12 measures radiation temperatures at the plurality of positions for each of thirty-six areas. The radiation temperature measurement unit 12 outputs, to the controller 33, radiation temperature data including a pair of information of the areas subjected to measurement and radiation temperatures at the plurality of positions measured in the areas subjected to measurement.

When the radiation temperature data is received from the radiation temperature measurement unit 12, the controller 33 compares the radiation temperature data with the area map illustrated in FIG. 14, and calculates an average value of the plurality of radiation temperatures included in the radiation temperature data for each area. The controller 33 sets the calculated average value of the radiation temperature for each area as a floor temperature of that area. The controller 33 writes in the floor temperature of each area to the area map illustrated in FIG. 14, to thereby generate floor temperature distribution.

In a case in which the operation state of the air-conditioning apparatus 1 is a heating operation, the controller 33 refers to the floor temperature distribution, and controls the up-and-down airflow direction adjusters 4*a* to 4*d* and the plurality of right-and-left airflow direction adjusters 6 to operate in association with each other so that the blowing direction of the air is directed to an area with the lowest floor temperature among the plurality of areas. Further, in a case in which the operation state of the air-conditioning apparatus 1 is a cooling operation, the controller 33 refers to the floor temperature distribution, and controls the up-and-down airflow direction adjusters 4*a* to 4*d* and the plurality of right-and-left airflow direction adjusters 6 to operate in association with each other so that the blowing direction of the air is directed to an area with the highest floor temperature among the plurality of areas.

Figure 24:
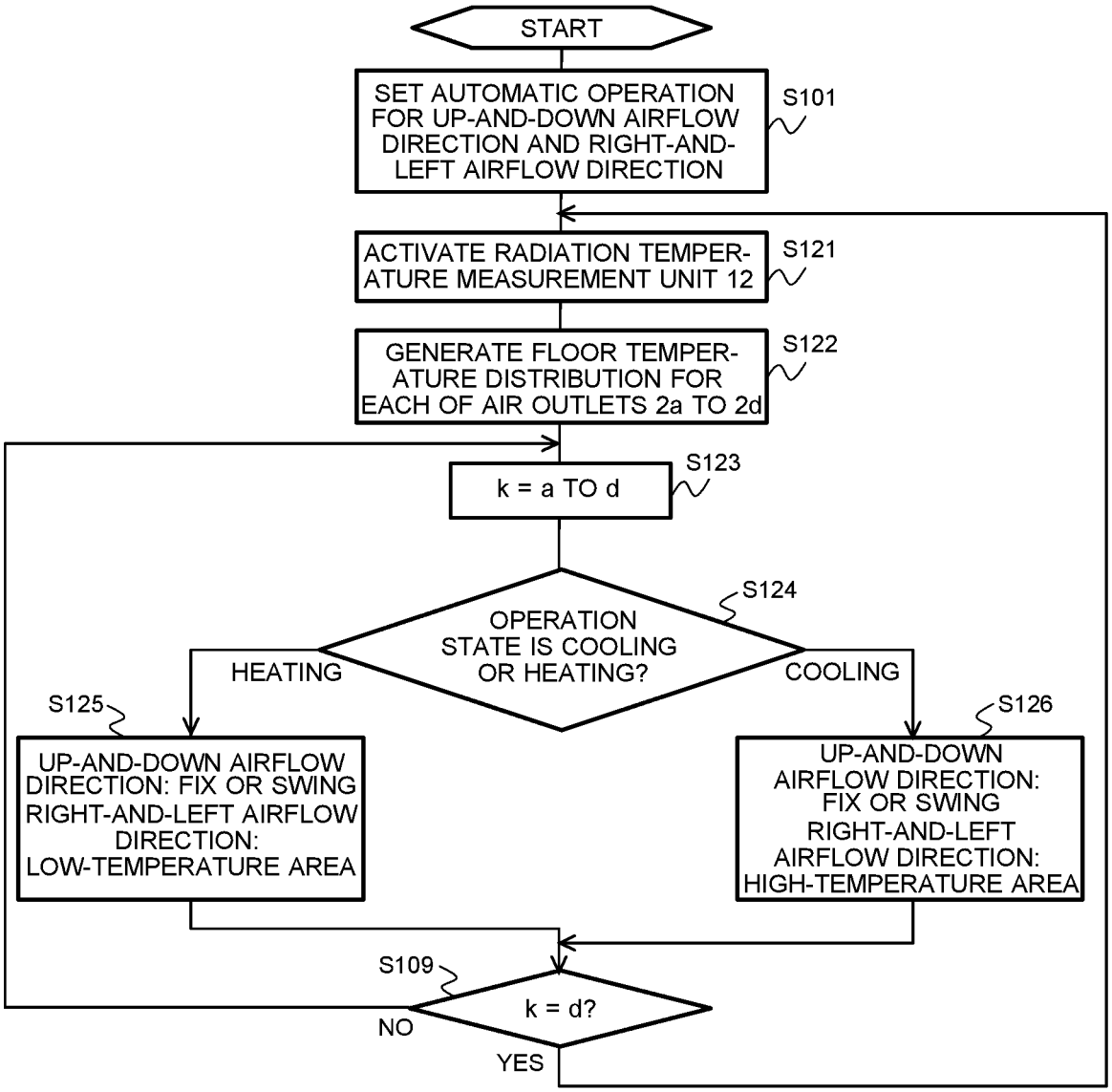
FIG. 24 is a flowchart for illustrating a procedure of airflow direction control performed by the indoor unit for an air-conditioning apparatus according to Embodiment 5 of the present invention.
Figure 25:
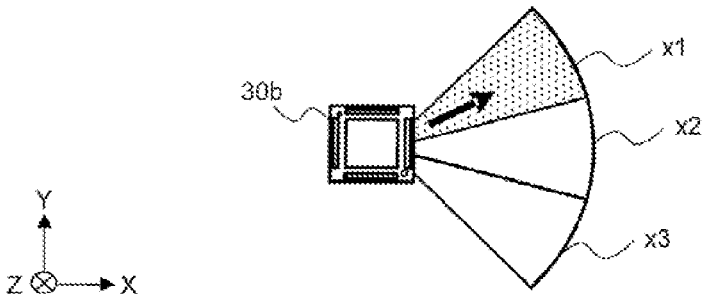
FIG. 25 is an illustration of an example of a case in which an area having a floor temperature lower than floor temperatures in other areas among a plurality of areas is present in Embodiment 5 of the present invention.
Figure 26:
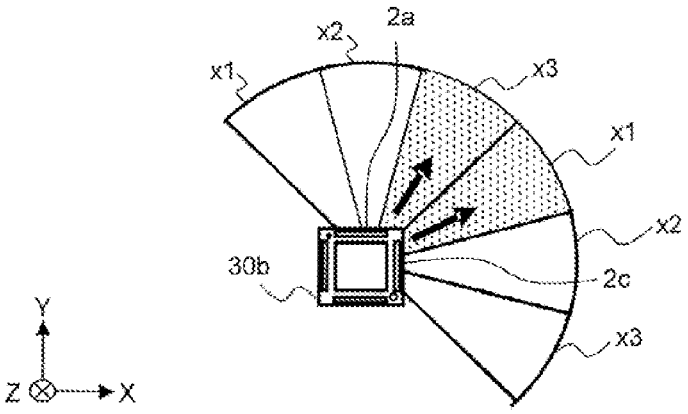
FIG. 26 is an illustration of an example of a case in which areas having floor temperatures higher than floor temperatures in other areas among the plurality of areas are present in Embodiment 5 of the present invention.

Next, description is made of an operation of the air-conditioning apparatus in Embodiment 5. FIG. 24 is a flowchart for illustrating a procedure of airflow direction control performed by the indoor unit for the air-conditioning apparatus according to Embodiment 5 of the present invention. FIG. 25 is an illustration of an example of a case in which an area having a floor temperature lower than floor temperatures of other areas among the plurality of areas is present in Embodiment 5 of the present invention. FIG. 26 is an illustration of an example of a case in which an area having a floor temperature higher than floor temperatures of other areas among the plurality of areas is present in Embodiment 5 of the present invention. In FIG. 25 and FIG. 26, for ease of description, each area is not divided into the area y1 to the area y3.

As illustrated in FIG. 24, when the instruction to set the automatic operation to the up-and-down airflow direction and the right-and-left airflow direction is input (Step S101), the controller 33 activates the radiation temperature measurement unit 12 (Step S121). When the radiation temperature data for each area is collected from the radiation temperature measurement unit 12, the controller 33 generates floor temperature distribution for the air-conditioning target space of each of the air outlets 2*a* to 2*d* (Step S122). In Step S123 to Step S126, the controller 33 performs determination in Step S124 for each of the air outlets 2*a* to 2*d*, and performs processing of any one of Step S125 and Step S126 in accordance with a determination result.

First, with reference to FIG. 25, description is made of airflow direction control to be performed by the indoor unit 30*b* for the air outlet 2*c* in the case in which the operation state of the air-conditioning apparatus 1 is the heating operation. With the determination in Step S124 illustrated in FIG. 24, when it is determined that the operation state of the air-conditioning apparatus 1 is the heating operation, the controller 33 proceeds to Step S125. In Step S125, the controller 33 refers to the floor temperature distribution to control the up-and-down airflow direction adjuster 4*c* and the right-and-left airflow direction adjuster 6 to operate in association with each other so that the blowing direction of the air is directed to the area with the lowest floor temperature among the plurality of areas. FIG. 25 is an illustration indicating that the area x1 illustrated with a dot pattern has a temperature lower than those of the other area x2 and the other area x3.

In the case of the example illustrated in FIG. 25, in Step S125, the controller 33 causes the airflow direction of the right-and-left airflow direction adjuster 6 to be directed to the area x1, and causes the airflow direction of the up-and-down airflow direction adjuster 4*c* to swing. In Step S125, in a case of controlling the blowing direction of the air per area with regard to the area y1 to the area y3 illustrated in FIG. 14, the controller 33 may fix the airflow direction of the up-and-down airflow direction adjuster 4*c* to an area having a low floor temperature.

In the case in which the operation state of the air-conditioning apparatus 1 is the heating operation, of the blowing direction of the air, the right-and-left direction is fixed to the area x1 with the lowest floor temperature, and the up-and-down direction is caused to swing to a plurality of areas or fixed to the area with the lowest floor temperature. As a result, warm air can be preferentially allocated to the area with the lowest floor temperature.

Next, with reference to FIG. 26, description is made of airflow direction control to be performed by the indoor unit 30*b* for the air outlets 2*a* and 2*c* in the case in which the operation state of the air-conditioning apparatus 1 is the cooling operation. In a procedure illustrated in FIG. 24, in the case of the air outlet 2*a* (Step S123), with the determination in Step S124, when it is determined that the operation state of the air-conditioning apparatus 1 is the cooling operation, the controller 33 proceeds to Step S126. In Step S126, the controller 33 refers to the floor temperature distribution to control the up-and-down airflow direction adjuster 4*a* and the right-and-left airflow direction adjuster 6 to operate in association with each other so that the blowing direction of the air is directed to the area with the highest floor temperature among the plurality of areas. FIG. 26 is an illustration indicating that the area x3 illustrated with a dot pattern has a temperature higher than those of other area x1 and other area x2 among the plurality of areas of the air outlet 2*a*.

In the case of the example illustrated in FIG. 26, in Step S126, the controller 33 causes the airflow direction of the right-and-left airflow direction adjuster 6 to be directed to the area x3 of the air outlet 2*a*, and causes the airflow direction of the up-and-down airflow direction adjuster 4*a* to swing. In Step S126, in the case of controlling the blowing direction of the air per area with regard to the areas y1 to the area y3 illustrated in FIG. 14, the controller 33 may fix the airflow direction of the up-and-down airflow direction adjuster 4*a* to an area having a high floor temperature.

Next, description is made of the airflow direction control for the case of the air outlet 2*c* in Step S123 illustrated in FIG. 24. FIG. 26 is an illustration indicating that the area x1 illustrated with a dot pattern has a temperature higher than those of other area x2 and other area x3 among the plurality of areas of the air outlet 2*c*. In Step S126, the controller 33 causes the airflow direction of the right-and-left airflow direction adjuster 6 to be directed to the area x3, and causes the airflow direction of the up-and-down airflow direction adjuster 4*c* to swing. In Step S126, in the case of controlling the blowing direction of the air per area to be directed to the area y1 to the area y3 illustrated in FIG. 14, the controller 33 may fix the airflow direction of the up-and-down airflow direction adjuster 4*a* to an area having a high floor temperature.

In the case in which the operation state of the air-conditioning apparatus 1 is the cooling operation, of the blowing direction of the air, the right-and-left direction is fixed to the area with the highest floor temperature, and the up-and-down direction is caused to swing to the plurality of areas or fixed to the area with the highest floor temperature. As a result, cool air can be preferentially allocated to the area with the highest floor temperature. As described above, in any of the cases in which the operation state of the air-conditioning apparatus 1 is the heating operation or the cooling operation, a portion with the temperature unevenness can be automatically and intensively air-conditioned.

In the indoor unit 30*b* for the air-conditioning apparatus 1 according to Embodiment 5, the controller 33 causes the blowing direction of the air to be directed to an area with the highest floor temperature among the plurality of floor temperatures during the cooling operation, and causes the blowing direction of the air to be directed to an area with the lowest floor temperature among the plurality of floor temperatures during the heating operation.

According to Embodiment 5, the controller 33 detects the temperature unevenness of the floor temperatures at the plurality of areas in the air-conditioning target space, and controls the up-and-down airflow direction and the right-and-left airflow direction in association with each other so that the blowing direction of the air is directed to an area in which the floor temperature is the most different among the floor temperatures at the plurality of areas. Consequently, the temperature unevenness is reduced more rapidly in the air-conditioning target space, thereby being capable of attaining even temperature. Further, the air-conditioning apparatus 1 performs the control similar to the above-mentioned control for each of the four air outlets 2*a* to 2*d*, thereby being capable of promptly attaining even temperature in the entire room. Further, the air-conditioning apparatus 1 can shorten the time required for improving the heating performance and the cooling performance, thereby being capable of also achieving energy-saving performance.

The configurations and the operations of the air-conditioning apparatus in Embodiments 1 to 5 described above are examples, and the configurations and operations of those embodiments may be combined.

REFERENCE SIGNS LIST

1 air-conditioning apparatus 2*a* to 2*d* air outlet 3 air inlet 4*a* to 4*d* up-and-down airflow direction adjuster 5 temperature measurement unit 6 right-and-left airflow direction adjuster 7 load-side heat exchanger 8 air-sending unit 10 humidity measurement unit 11 human body position detection unit 12 radiation temperature measurement unit 20 outdoor unit 21 compressor 22 four-way valve 23 heat source-side heat exchanger 24 expansion valve 25 refrigerant circuit 30, 30*a*, 30*b* indoor unit 31 lower surface 32*a* upper casing 32*b* lower casing 33 controller 35 memory 36 CPU 37, 38 drive unit 41 up-and-down vane 42 shaft portion 45 upper side 46 middle 47 lower side 51 to 53, 55 to 58 arrow 61*a*, 61*b* right-and-left vane 62 hinge 63 shaft portion

The invention claimed is:

1. An indoor unit for an air-conditioning apparatus, comprising:

a fan configured to send air subjected to heat exchange with refrigerant to an air-conditioning target space through an air outlet, the air-conditioning target space being divided into a plurality of areas;

an up-and-down airflow direction adjusting vane provided at the air outlet, and configured to adjust an angle in an up-and-down direction of a blowing direction of the air sent through the air outlet;

a right-and-left airflow direction adjusting vane provided at the air outlet, and configured to adjust an angle in a right-and-left direction of the blowing direction of the air sent through the air outlet; and a controller configured to control the angle of the up-and-down airflow direction adjusting vane and the angle of the right-and-left airflow direction adjusting vane, the controller being configured to control the up-and-down airflow direction adjusting vane and the right-and-left airflow direction adjusting vane to continuously and simultaneously change the angle in the up-and-down direction and the angle in the right-and-left direction such that the blowing direction of the air is switched to areas of the plurality of areas, wherein, when a heating operation is performed, the controller is configured to set, in entire time for switching the blowing direction of the air per area, a ratio of time for an area having a shortest distance to be larger than a ratio of time for other areas in the direction in which the distance from the air outlet as the reference increases.

2. An indoor unit for an air-conditioning apparatus, comprising:

a fan configured to send air subjected to heat exchange with refrigerant to an air-conditioning target space through an air outlet, the air-conditioning target space being divided into a plurality of areas;

an up-and-down airflow direction adjusting vane provided at the air outlet, and configured to adjust an angle in an up-and-down direction of a blowing direction of the air sent through the air outlet;

a right-and-left airflow direction adjusting vane provided at the air outlet, and configured to adjust an angle in a right-and-left direction of the blowing direction of the air sent through the air outlet; and a controller configured to control the angle of the up-and-down airflow direction adjusting vane and the angle of the right-and-left airflow direction adjusting vane, the controller being configured to control the up-and-down airflow direction adjusting vane and the right-and-left airflow direction adjusting vane to continuously change the angle in the up-and-down direction and the angle in the right-and-left direction such that the blowing direction of the air is switched to areas of the plurality of areas, wherein the plurality of areas are areas divided in a direction in which a distance from the air outlet as a reference increases and in a direction horizontal to the reference, and when a heating operation is performed, the controller is configured to set, in entire time for switching the blowing direction of the air per area, a ratio of time for an area having a shortest distance to be larger than a ratio of time for other areas in the direction in which the distance from the air outlet as the reference increases.

3. The indoor unit for an air-conditioning apparatus of claim 1, wherein the controller is configured to simultaneously control the up-and-down airflow direction adjusting vane and the right-and-left airflow direction adjusting vane to operate in association with each other such that a trajectory of the blowing direction of the air to the plurality of areas is 8-shaped.

4. The indoor unit for an air-conditioning apparatus of claim 2, further comprising a human body position detection sensor configured to detect whether or not a person is present for each of the plurality of areas, wherein the controller is configured to control the up-and-down airflow direction adjusting vane and the right-and-left airflow direction adjusting vane to operate in association with each other to cause the blowing direction of the air to be directed to an area, among the plurality of areas, detected by the human body position detection sensor in which a person is present.

5. The indoor unit for an air-conditioning apparatus of claim 2, further comprising a human body position detection sensor configured to detect whether or not a person is present for each of the plurality of areas, wherein the controller is configured to control the up-and-down airflow direction adjusting vane and the right-and-left airflow direction adjusting vane to operate in association with each other to cause the blowing direction of the air to be directed to an area, among the plurality of areas, detected by the human body position detection sensor in which a person is absent.

6. The indoor unit for an air-conditioning apparatus of claim 1, further comprising a radiation temperature measurement sensor configured to measure a floor temperature for each of the plurality of areas, wherein, when a cooling operation is performed, the controller is configured to cause the blowing direction of the air to be directed to an area having a highest floor temperature among a plurality of floor temperatures measured by the radiation temperature measurement sensor for the plurality of areas, and wherein, when a heating operation is performed, the controller is configured to cause the blowing direction of the air to be directed to an area having a lowest floor temperature among the plurality of floor temperatures.

7. The indoor unit for an air-conditioning apparatus of claim 1, further comprising a temperature measurement sensor configured to measure a temperature of air to be sucked in from the air-conditioning target space, wherein, when a cooling operation is performed and the temperature measured by the temperature measurement sensor does not fall within a range determined for a set temperature, the controller is configured to control the angle of the up-and-down airflow direction adjusting vane and the angle of the right-and-left airflow direction adjusting vane.

8. The indoor unit for an air-conditioning apparatus of claim 1, further comprising a humidity measurement sensor configured to measure a humidity of air to be sucked in from the air-conditioning target space, wherein, when a cooling operation is performed and the humidity measured by the humidity measurement sensor does not fall within a range determined for a set humidity, the controller is configured to control the angle of the up-and-down airflow direction adjusting vane and the angle of the right-and-left airflow direction adjusting vane.

9. The indoor unit for an air-conditioning apparatus of claim 2, further comprising a radiation temperature measurement sensor configured to measure a floor temperature for each of the plurality of areas, wherein, when a cooling operation is performed, the controller is configured to cause the blowing direction of the air to be directed to an area having a highest floor temperature among a plurality of floor temperatures measured by the radiation temperature measurement sensor for the plurality of areas, and wherein, when a heating operation is performed, the controller is configured to cause the blowing direction of the air to be directed to an area having a lowest floor temperature among the plurality of floor temperatures.

10. The indoor unit for an air-conditioning apparatus of claim 2, further comprising a temperature measurement sensor configured to measure a temperature of air to be sucked in from the air-conditioning target space, wherein, when a cooling operation is performed and the temperature measured by the temperature measurement sensor does not fall within a range determined for a set temperature, the controller is configured to control the angle of the up-and-down airflow direction adjusting vane and the angle of the right-and-left airflow direction adjusting vane.

11. The indoor unit for an air-conditioning apparatus of claim 2, further comprising a humidity measurement sensor configured to measure a humidity of air to be sucked in from the air-conditioning target space, wherein, when a cooling operation is performed and the humidity measured by the humidity measurement sensor does not fall within a range determined for a set humidity, the controller is configured to control the angle of the up-and-down airflow direction adjusting vane and the angle of the right-and-left airflow direction adjusting vane.

12. The indoor unit for an air-conditioning apparatus of claim 4, wherein the controller is further configured to control the up-and-down direction adjusting vane to continuously change the angle in the up-and-down direction in the area detected by the human body position sensor in which the person is present.

13. The indoor unit for an air-conditioning apparatus of claim 2, further comprising a human body position detection sensor configured to detect whether or not a person is present for each of the plurality of areas, wherein the controller is further configured to control the up-and-down direction adjusting vane to fix the angle in the up-and-down direction irrespective of whether the human body position sensor detects a person in an area.

* * * * *